US012031768B2

(12) United States Patent
Lee et al.

(10) Patent No.: US 12,031,768 B2
(45) Date of Patent: Jul. 9, 2024

(54) REFRIGERATOR

(71) Applicant: LG Electronics Inc., Seoul (KR)

(72) Inventors: Hyeon Seong Lee, Seoul (KR); Yong Hyeon Cho, Seoul (KR); Sung Hee Kang, Seoul (KR); Jung Hyuk Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 54 days.

(21) Appl. No.: 17/077,578

(22) Filed: Oct. 22, 2020

(65) Prior Publication Data

US 2021/0172670 A1 Jun. 10, 2021

(30) Foreign Application Priority Data

Dec. 9, 2019 (KR) ..... 10-2019-0163014

(51) Int. Cl.
*F25D 17/06* (2006.01)
*F25C 1/00* (2006.01)
(Continued)

(52) U.S. Cl.
CPC ..... *F25D 17/065* (2013.01); *F25C 1/00* (2013.01); *F25D 17/067* (2013.01); *F25D 17/08* (2013.01);
(Continued)

(58) Field of Classification Search
CPC ..... F25D 17/065; F25D 17/067; F25D 17/08; F25D 23/02; F25D 29/001;
(Continued)

(56) References Cited

U.S. PATENT DOCUMENTS 5,911,750 A * 6/1999 Mandel et al. ..... F25D 17/065 62/407
2008/0006043 A1* 1/2008 Lee et al. ..... F25D 17/04 62/186
(Continued)

FOREIGN PATENT DOCUMENTS

CN 1231412 10/1999
CN 1648562 8/2005
(Continued)

OTHER PUBLICATIONS

JP-11223450-A Translation (Year: 1999).*
(Continued)

*Primary Examiner* — Elizabeth J Martin
*Assistant Examiner* — Dario Antonio Deleon
(74) *Attorney, Agent, or Firm* — Fish & Richardson P.C.

(57) ABSTRACT

A refrigerator includes a cabinet, an evaporator, a shroud, a grille panel coupled to a front surface of the shroud, and a blower fan module disposed between the grille panel and the shroud and configured to blow the cool air from the evaporator toward a freezing compartment. The blower fan module includes an installation frame defining a first plane that faces a rear surface of the grille panel, and a second plane that faces the front surface of the shroud, a hub part that is rotatably coupled to the second plane of the installation frame and faces an inlet hole of the shroud, and a blower impeller disposed in the hub part.

14 Claims, 30 Drawing Sheets

(51) Int. Cl.
*F25D 17/08* (2006.01)
*F25D 23/02* (2006.01)
*F25D 29/00* (2006.01)

(52) U.S. Cl.
CPC ..... *F25D 23/02* (2013.01); *F25D 29/001* (2013.01); *F25D 2317/061* (2013.01); *F25D 2317/063* (2013.01); *F25D 2317/0671* (2013.01); *F25D 2317/0672* (2013.01)

(58) Field of Classification Search
CPC ..... F25D 2317/061; F25D 2317/063; F25D 2317/0671; F25D 2317/0672; F25D 2317/0666; F25D 2317/0681; F25D 2317/0682; F25D 11/02; F25D 17/04; F25D 17/045; F25D 17/062; F25D 23/003; F25D 23/12; F25D 29/003; F25D 2317/06; F25C 1/00
See application file for complete search history.

(56) References Cited

U.S. PATENT DOCUMENTS

| | | | | |
|---|---|---|---|---|
| 2008/0148761 | A1 | 6/2008 | Venkatakrishnan et al. | |
| 2016/0178265 | A1* | 6/2016 | Lee | F25D 17/06 |
| 2018/0283765 | A1* | 10/2018 | Yi et al. | F25D 17/06 |
| 2019/0056165 | A1* | 2/2019 | Shin et al. | F25D 17/062 |
| 2019/0301786 | A1* | 10/2019 | Lee et al. | F25D 17/08 |
| 2021/0010740 | A1* | 1/2021 | Lee et al. | F25D 2317/063 |

FOREIGN PATENT DOCUMENTS

| | | | | | |
|---|---|---|---|---|---|
| CN | 1928471 | | | 3/2007 | |
| CN | 102472550 | | | 5/2012 | |
| CN | 103185431 | | | 7/2013 | |
| CN | 107166838 | | | 9/2017 | |
| CN | 107436066 | | | 12/2017 | |
| CN | 107588586 | | | 1/2018 | |
| CN | 107883643 | | | 4/2018 | |
| CN | 109282554 | | | 1/2019 | |
| DE | 202005014383 | | | 1/2006 | |
| DE | 102018212564 | | | 2/2019 | |
| DE | 102018212564 | A1 | * | 2/2019 | F25D 17/06 |
| EP | 3249325 | | | 5/2017 | |
| EP | 3301385 | | | 4/2018 | |
| EP | 3301385 | A1 | * | 4/2018 | F25D 17/06 |
| EP | 3447408 | A1 | * | 2/2019 | F25D 17/06 |
| JP | 11223450 | A | * | 8/1999 | F25D 17/06 |
| JP | H11223450 | | | 8/1999 | |
| JP | 2001147070 | A | * | 5/2001 | F25D 25/025 |
| KR | 1020040020616 | | | 3/2004 | |
| KR | 1020060129664 | | | 12/2006 | |
| KR | 100918445 | | | 9/2009 | |
| KR | 1020090101525 | | | 9/2009 | |
| KR | 101659622 | | | 9/2016 | |
| KR | 101659622 | B1 | * | 9/2016 | F25D 29/00 |
| WO | WO2017039332 | | | 3/2017 | |

OTHER PUBLICATIONS

DE-102018212564-A1 Translation (Year: 2019).*
KR-101659622-B1 Translation (Year: 2016).*
JP 2001147070 A Translation (Year: 2001).*
Office Action in Australian Appln. No. 2020260538, dated Oct. 21, 2021, 4 pages.
EP Extended European Search Report in European Appln. No. 20204907.8, dated Apr. 21, 2021, 8 pages.
Office Action in Chinese Application No. 202011285326.5, dated Mar. 8, 2022, 12 pages (with English translation).
Notice of Allowance in Chinese Appln. No. 202011285326.5, dated Sep. 14, 2022, 7 pages (with English translation).

* cited by examiner

REFRIGERATOR

CROSS-REFERENCE TO RELATED APPLICATION

The present application claims priority to Korean Patent Application No. 10-2019-0163014, filed on Dec. 9, 2019, the entire contents of which is incorporated herein for all purposes by reference.

TECHNICAL FIELD

The present disclosure relates to a refrigerator having a grille panel assembly that guides supply of cool air to a storage compartment.

BACKGROUND

A refrigerator is a home appliance that can store various objects such as food items for a certain time by cool air generated by circulation of a refrigerant through a refrigeration cycle.

The refrigerator may include one or a plurality of partitioned storage compartments for cooling stored objects.

The storage compartments may include a freezing compartment for freezing storage of objects and a refrigerating compartment for refrigerating of stored objects. In some cases, the refrigerator may include at least two freezing compartments or at least two refrigerating compartments.

In some examples, the refrigerator may include an evaporator provided in a rear wall surface in a cabinet, that is, in a rear side portion in the storage compartment, and a grille panel assembly installed in the front of the evaporator. The grille panel assembly can guide cool air that is heat-exchanged while passing through the evaporator to be supplied to the storage compartment.

For instance, by an air blowing force of a fan in the grille panel assembly, air in the cabinet can exchange heat while passing through the evaporator to become cool air, and the cool air may be supplied to each portions in the storage compartment by guidance of the grille panel assembly.

In some cases, the grille panel assembly may have flow of cool air that is not evenly supplied to the entire area in the storage compartment.

For example, the grille panel assembly may discharge cool air only forward, and supply of cool air to side spaces in the storage compartment may not be performed efficiently.

In some examples, where cool air is not sufficiently supplied to a stored object positioned the side spaces in the storage compartment, the storage quality of the stored object may be lowered compared to a stored object located in a center space in the storage compartment.

In some cases, the refrigerator may include an ice maker for ice-making in the freezing compartment of the refrigerator.

The ice maker may include an ice tray for ice-making, or an ice-making compartment in which the ice tray is built.

In some cases, an ice-making time or quality of ice may vary due to the temperature conditions in the freezing compartment.

For example, when the freezing compartment is not frequently opened and maintains a predetermined temperature, the ice-making time may be reduced and good quality ice may be made. In some cases, when the freezing compartment is frequently opened and does not maintain the predetermined temperature, it may take a long time to make ice and the inside of ice may not be frozen properly.

In some cases, where the ice maker is positioned in the front in the freezing compartment for ease of use, cool air discharged from the grille panel assembly positioned in the rear side of the freezing compartment may not sufficiently reach the ice maker, which may result in decreasing the ice-making efficiency and generating hollow ice cubes.

SUMMARY

The present disclosure describes a refrigerator including a grille panel, where a front to rear width of the grille panel assembly is reduced so that more storage space in a storage compartment can be secured.

The present disclosure also describes a refrigerator including a freezing compartment, where cool air supplied to the freezing compartment can be sufficiently supplied to left and right side spaces in the freezing compartment.

The present disclosure further describes a refrigerator including an ice maker, where cool air supplied to the freezing compartment can be supplied to the ice maker positioned in any one side in the freezing compartment, and the cool air can be efficiently supplied to stored objects positioned in a lower portion of the ice maker at the side.

The present disclosure further describes a refrigerator including an ice maker positioned in a front space in the freezing compartment, where cool air can be efficiently supplied to the ice maker.

The present disclosure further describes a refrigerator including common fan modules, where cool air can be efficiently supplied to the freezing compartment and an ice-making compartment.

According to one aspect of the subject matter described in this application, a refrigerator includes a cabinet having a freezing compartment and a refrigerating compartment, an evaporator disposed inside the freezing compartment and configured to cool air, a shroud that is disposed at a front side of the evaporator and defines an inlet hole configured to communicate with the freezing compartment, where the shroud includes a plurality of fastening protrusions that are arranged around the inlet hole and protrude forward from the shroud, a grille panel that is coupled to a front surface of the shroud and defines a cool air outlet configured to discharge the cool air to the freezing compartment, and a blower fan module disposed between the grille panel and the shroud and configured to blow the cool air from the evaporator toward the cool air outlet. The blower fan module includes a blower installation frame that has a plate shape, that defines a plurality of fastening holes coupled to the plurality of fastening protrusions, and that defines a first plane that faces a rear surface of the grille panel, and a second plane that faces the front surface of the shroud, a blower hub part that is rotatably coupled to the second plane of the blower installation frame and faces the inlet hole of the shroud, and a blower impeller disposed in the blower hub part.

Implementations according to this aspect may include one or more of the following features. For example, the shroud can include an inclined side wall surface and a vertical side wall surface connected to an end of the inclined side wall surface. The shroud can define an inflow side flow path part disposed around the inlet hole of the shroud, and an expansion side flow path part that extends across a lower portion of the inflow side flow path part and faces the inclined side wall surface and the vertical side wall surface, where an upper width of the shroud is narrower than a lower width of the shroud.

In some examples, the shroud can include a plurality of cool air guides that protrude forward from the expansion side flow path part, and the cool air outlet can include an upper cool air outlet that faces the inflow side flow path part of the shroud, and a plurality of lower cool air outlets that face the expansion side flow path part of the shroud.

In some implementations, the refrigerator can include an ice maker disposed in the freezing compartment, and a discharge guide duct coupled to a front surface of the upper cool air outlet and configured to supply the cool air to the ice maker. In some implementations, the refrigerator can include an air guide that has a round shape protruding from a side wall of the inflow side flow path part toward the inlet hole.

In some implementations, the grille panel can have a plate shape and include an upper portion that covers the inflow side flow path part, and a lower portion that covers the expansion side flow path part and protrudes forward relative to the upper portion. In some examples, the expansion side flow path part protrudes forward relative to the inflow side flow path part, and the evaporator is arranged at a rear side of the expansion side flow path part.

In some implementations, the shroud can include a plurality of assembly ribs that protrude forward from the front surface of the shroud and extends along the inclined side wall surface and the vertical side wall surface, and a plurality of first fastening holes defined between the plurality of assembly ribs. The grille panel can define a plurality of fastening extension grooves that receive the plurality of assembly ribs, and a plurality of second fastening holes that are disposed between the plurality of fastening extension grooves and face the plurality of first fastening holes such that the grille panel and the shroud are in contact with each other.

In some implementations, the refrigerator can include a door configured to open and close at least a portion of the refrigerating compartment, an ice-making compartment disposed at the door, a duct connection part disposed at the rear surface of the grille panel, an ice-making fan module disposed in an inside of the duct connection part and configured to supply the cool air to the ice-making compartment. In some examples, the duct connection part is arranged outside the shroud coupled to the grille panel.

In some examples, the duct connection part can include a duct body coupled to the grille panel, and a duct housing that is coupled to the duct body and defines an inlet configured to communicate with the ice-making compartment. The ice-making fan module can include a duct installation frame that has a plate shape and includes a first side that faces the duct body and a second side that faces the duct housing, a duct hub part that is rotatably coupled to the second side of the duct installation frame and faces the inlet of the duct housing, and a duct impeller disposed in the duct hub part.

In some implementations, a size of the duct impeller is equal to a size of the blower impeller, and a diameter of the inlet of the duct housing is less than a diameter of the inlet hole of the shroud.

In some implementations, the refrigerator can include a temperature sensor disposed at a front surface of the grille panel and positioned outside the shroud coupled to the grille panel. In some implementations, the cool air outlet can include an outlet that protrudes forward from a center portion of the front surface of the grille panel, where the outlet has a front side that is closed and lateral sides that are open toward side walls of the freezing compartment.

In some implementations, a cross-section of the blower installation frame has a circular shape, and the blower installation frame includes a plurality of side protrusions that radially extend from the circular shape and define the plurality of fastening holes, and a cut part that is disposed at an upper side of the blower installation frame and has a flat cut shape.

According to another aspect, a refrigerator includes a cabinet having a refrigerating compartment and a freezing compartment disposed below the refrigerating compartment, a door configured to open and close at least a portion of the refrigerating compartment, an ice-making compartment disposed at the door, an evaporator disposed inside the freezing compartment and configured to cool air, a shroud that is disposed at a front side of the evaporator and defines an inlet hole configured to communicate with the freezing compartment, wherein the shroud includes an inclined side wall surface disposed at an upper portion of the shroud and a vertical side wall surface disposed at a lower portion of the shroud, a grille panel that is coupled to a front surface of the shroud and defines a cool air outlet configured to discharge the cool air toward the freezing compartment, and a blower fan module disposed between the shroud and the grille panel and configured to blow the cool air from the evaporator toward the cool air outlet. The blower fan module includes a blower installation frame that has a plate shape, the blower installation frame defining a first plane that faces a rear surface of the grille panel, and a second plane that faces the front surface of the shroud, a blower hub part that is rotatably coupled to the second plane of the blower installation frame and faces the inlet hole of the shroud, and a blower impeller disposed in the blower hub part. The refrigerator further includes a duct connection part that is coupled to the rear surface of the grille panel and defines an inlet configured to communicate with the ice-making compartment, and an ice-making fan module disposed at an inside of the duct connection part and configured to supply the cool air to the ice-making compartment. The duct connection part is arranged inside a space that is defined by a rear wall of the freezing compartment, the inclined side wall surface of the shroud, and the grille panel.

Implementations according to this aspect may include one or more of the following features. For example, the shroud can define an inflow side flow path part disposed around the inlet hole of the shroud, and an expansion side flow path part that extends across a lower portion of the inflow side flow path part and faces the inclined side wall surface and the vertical side wall surface. In some examples, the duct connection part can include a side portion located at a side portion of the inflow side flow path part, and a lower part of the side portion facing the inclined side wall surface.

In some implementations, the blower fan module and the ice-making fan module can include a same type of fans, where a diameter of the inlet is less than a diameter of the inlet hole of the shroud. In some implementations, the refrigerator can include an ice maker disposed in the freezing compartment, and a discharge guide duct coupled to a front surface of the cool air outlet and configured to guide the cool air to the ice maker.

In some implementations, the discharge guide duct can be provided in front of the cool air outlet. Accordingly, some of the cool air discharged through the cool air outlet can be intensively supplied toward a specific position.

In some implementations, where the cool air is continuously supplied toward the ice maker in the freezing compartment, it may be possible to reduce variation of ice quality due to overall temperature changes in the freezing compartment or flow variation of cool air flowing in the freezing compartment.

In some implementations, the discharge guide duct can include a tube body protruding forward from the first cool air outlet. Accordingly, the cool air can be directly supplied from the direct rear of the ice maker toward a rear surface of the ice maker.

In some implementations, part of cool air discharged through the first cool air outlet can flow to the discharge guide duct, and the remaining part of cool air can flow to the front or the side of the first cool air outlet without colliding with the discharge guide duct. Accordingly, part of cool air can be supplied toward the ice maker and the remaining cool air may be efficiently supplied to objects around the ice maker.

In some implementations, the duct connection part having the ice-making fan module can be provided in the portion of the rear surface of the grille panel where the shroud is not positioned. Accordingly, the grille panel assembly can be slimmed.

In some implementations, the blower fan module and the ice-making fan module can have the same size and use the same type of fans installed at respective inlet holes having different opening widths. Accordingly, cool air can be supplied as different air volumes and air speeds.

In some implementations, the fourth cool air outlet formed on the grille panel can be open toward the opposite side wall surfaces in the freezing compartment. Accordingly, the cool air can be supplied to the rear surface of the freezing compartment or the opposite wall surfaces in the rear side of the freezing compartment.

In some implementations, the fourth cool air outlet may be positioned at different height than the second cool air outlet and the third cool air outlet. Accordingly, interference between the cool air discharged toward the front side of the freezing compartment and the cool air discharged toward the opposite side wall surfaces of the freezing compartment can be prevented or reduced.

DETAILED DESCRIPTION

Hereinbelow, one or more implementations of a refrigerator will be described with reference to FIGS. 1 to 32.

Figure 1:
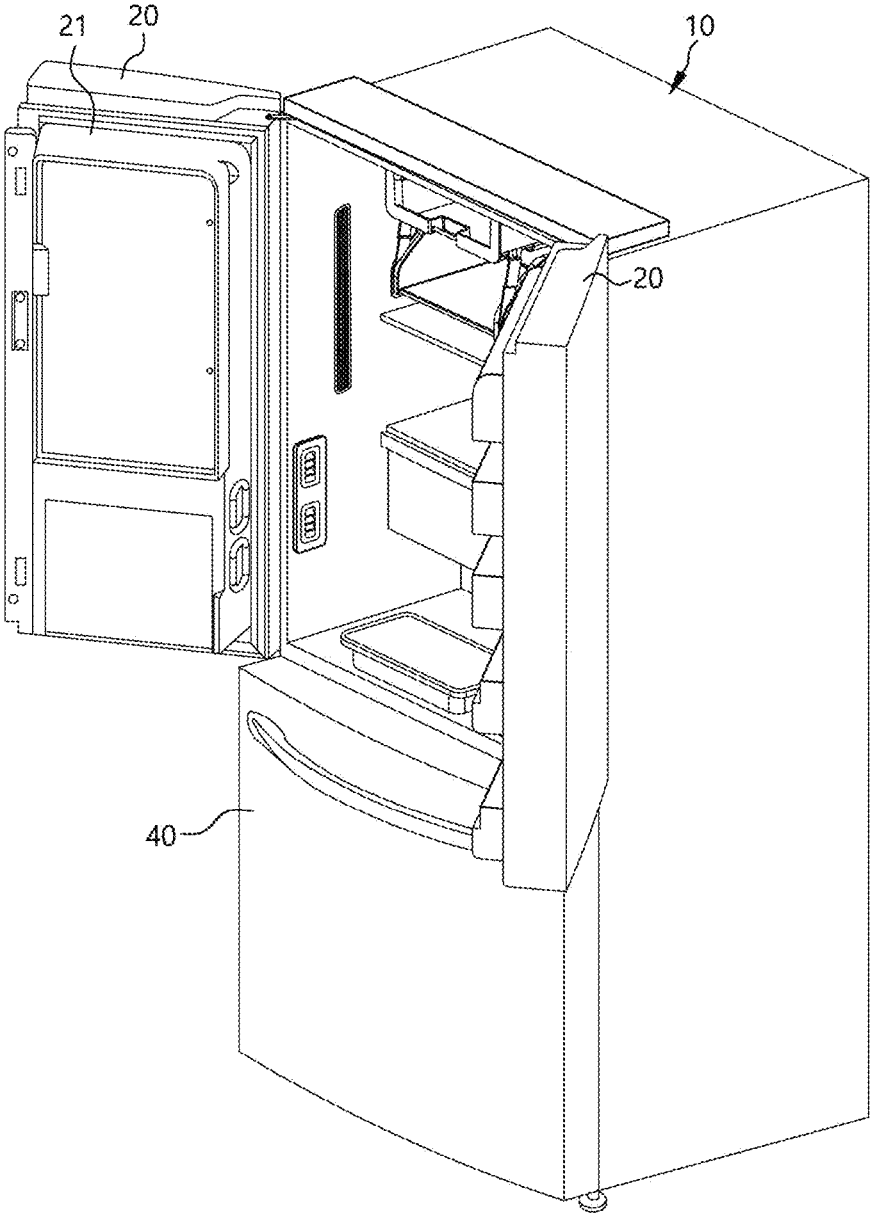
FIG. 1 is a perspective view showing an example of an exterior structure of an example refrigerator.
Figure 2:
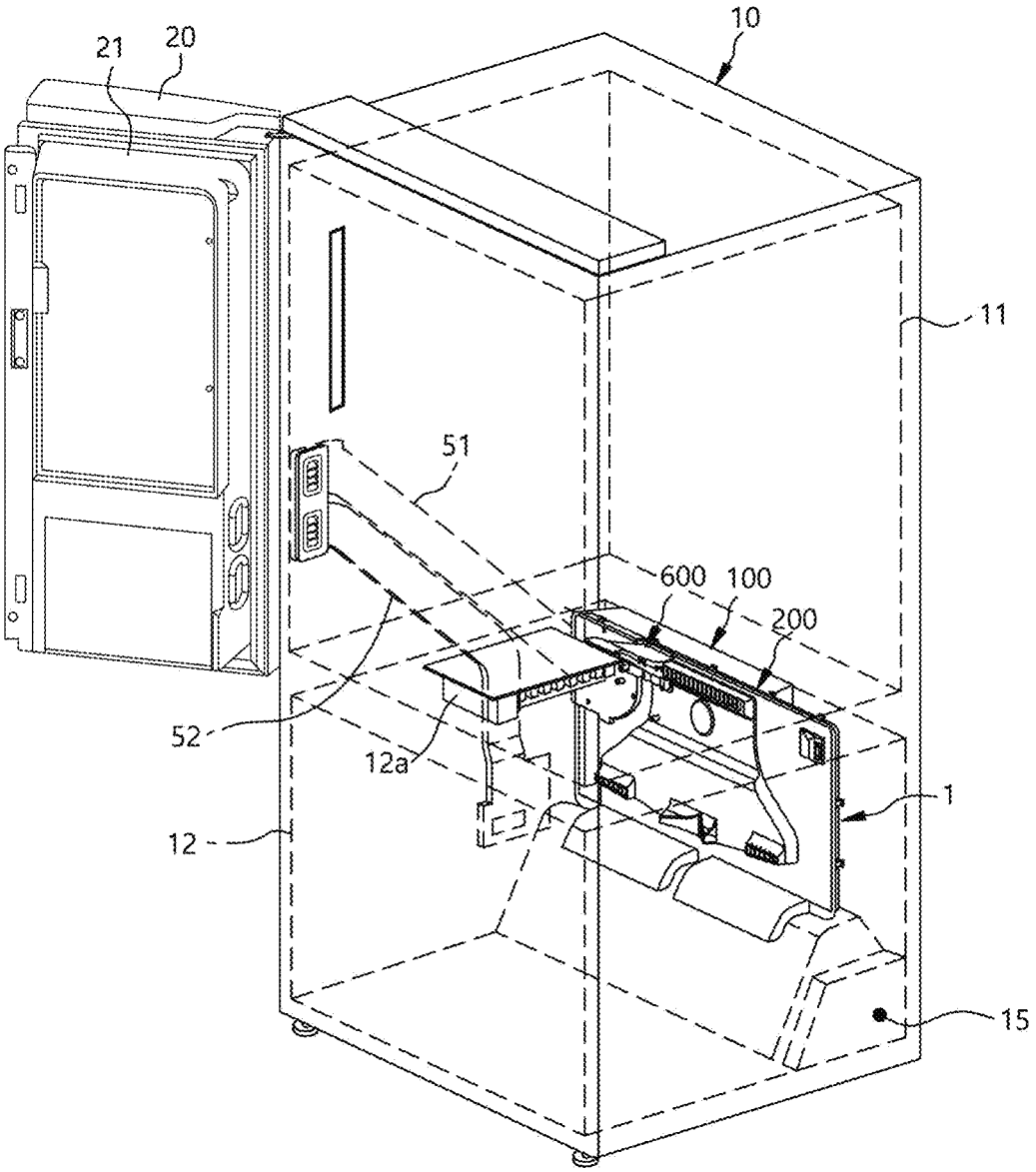
FIG. 2 is a perspective view schematically showing an example of an internal structure of the refrigerator.

FIG. 1 is a perspective view showing an example of an exterior structure of the refrigerator. FIG. 2 is a perspective view schematically showing an example of an internal structure of the refrigerator.

Figure 3:
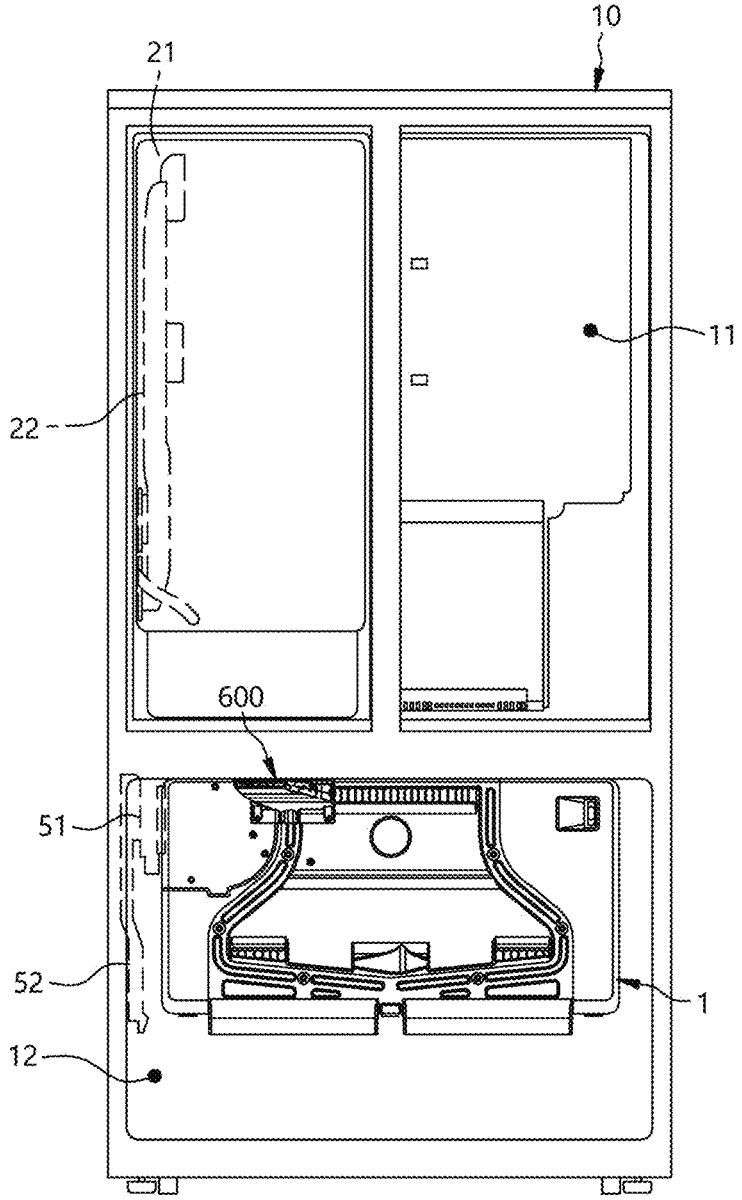
FIG. 3 is a front section view schematically showing the internal structure of the refrigerator.
Figure 4:
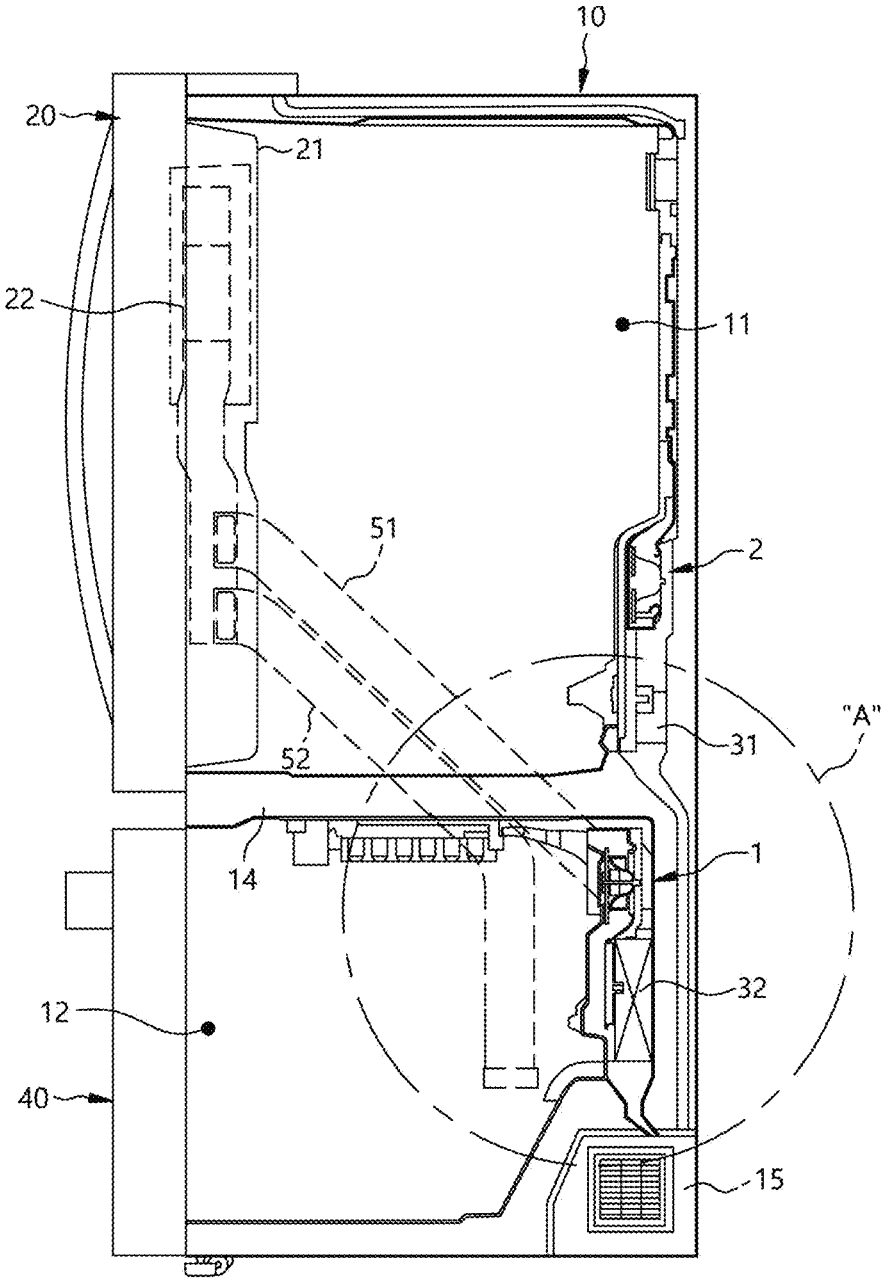
FIG. 4 is a side section view schematically showing the internal structure of the refrigerator.

FIG. 3 is a front section view schematically showing the internal structure of the refrigerator. FIG. 4 is a side section view schematically showing the internal structure of the refrigerator.

As shown in the drawings, the refrigerator may include a cabinet 10 having a refrigerating compartment 11 and a freezing compartment 12, and a refrigerating compartment door 20 having an ice-making compartment 21.

The refrigerating compartment 11 may be a storage compartment provided for refrigerating objects to be stored and may be opened and closed by the refrigerating compartment door 20. The freezing compartment 12 may be a storage compartment provided for freezing storage of objects and may be opened and closed by a freezing compartment door 40.

Figure 5:
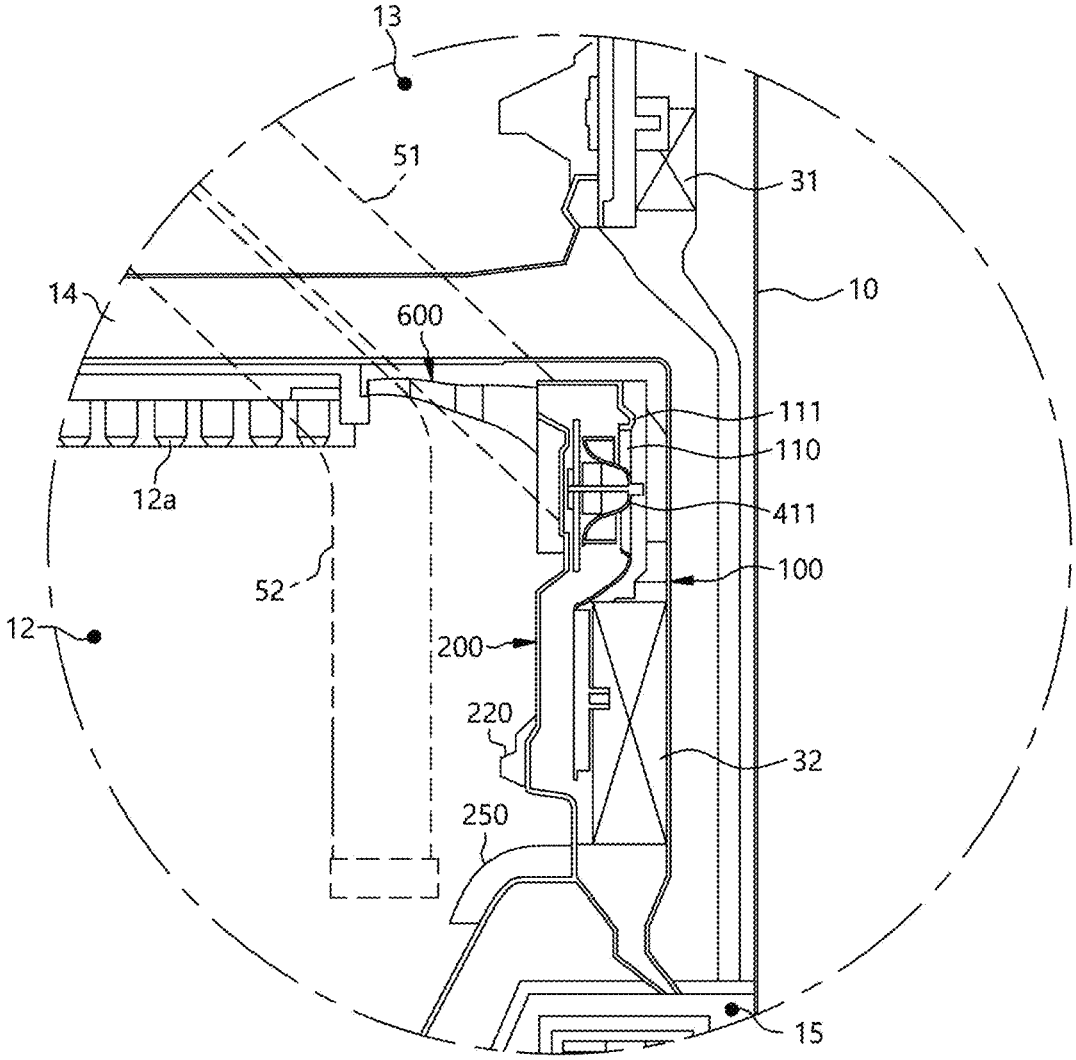
FIG. 5 is an enlarged view showing part "A" in FIG. 4.
Figure 6:
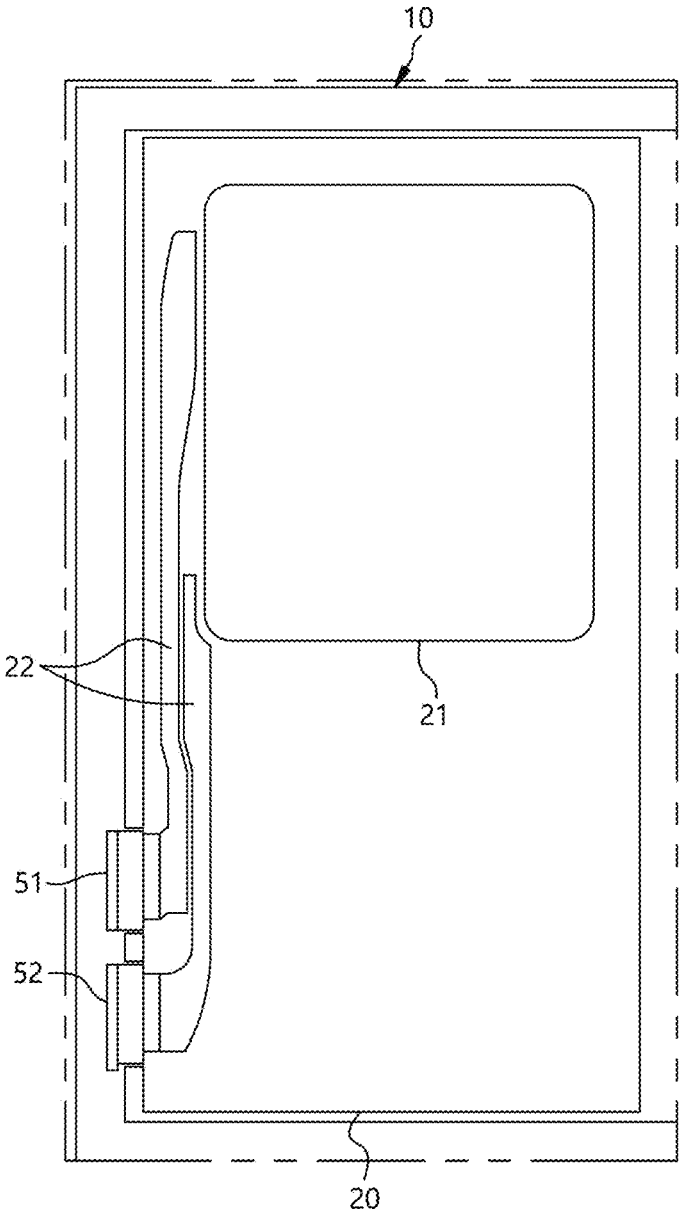
FIG. 6 is an enlarged view showing an example structure for supplying or recovering cool air to or from an ice-making compartment of the refrigerator.

In addition, on a rear wall surface in the cabinet 10, a first evaporator 31 may be provided at a rear side portion of the refrigerating compartment 11 and a second evaporator 32 may be provided at a rear side portion of the freezing compartment 12. The first evaporator 31 may be an evaporator provided to supply cool air to the refrigerating compartment 11. The second evaporator 32 may be an evaporator provided to supply cool air to the freezing compartment 12 and the ice-making compartment 21. The above structures are as shown in FIGS. 4 and 5.

The refrigerating compartment 11 may be provided in an upper space in the cabinet 10 and the freezing compartment 12 may be provided in a lower space in the cabinet 10. The storage compartment 11, 12 (refrigerating compartment and freezing compartment) may be partitioned by a partition wall 14 that may partition an inside space of the cabinet 10 into upper and lower spaces.

Furthermore, the refrigerating compartment door 20 may be a door that may open and close the refrigerating compartment 11, and may be configured as a rotary type door.

The ice-making compartment 21 may be provided in an inside of the refrigerating compartment door 20 (side positioned inside the refrigerating compartment when the refrigerating compartment door is closed). The ice-making compartment 21 may be a storage compartment configured such that an ice maker for making ice is provided in the refrigerating compartment door 20.

In addition, the freezing compartment door 40 may be open and close the freezing compartment 12 and may be configured as a drawer type door. The freezing compartment door 40 may be configured as a rotary type door.

Furthermore, an ice maker 12*a* may be provided in the freezing compartment 12, and the ice maker 12*a* may be positioned in an upper space in the freezing compartment 12.

A grille panel assembly 1, 2 may be provided in front of each evaporator 31, 32 in the cabinet 10. In some examples, the grille panel assembly may be referred to as a grille plate assembly, grill plate assembly, grille pan assembly, grill pan assembly, grille fan assembly, or grill fan assembly.

The grille panel assembly 1, 2 may include a grille panel assembly 2 provided in the refrigerating compartment 11 and a grille panel assembly 1 provided in the freezing compartment 12.

In some implementations, the grille panel assembly 1 provided in the freezing compartment 12 is an example of the grille panel assembly, and the freezing compartment 12 is an example of the storage compartment.

Figure 7:
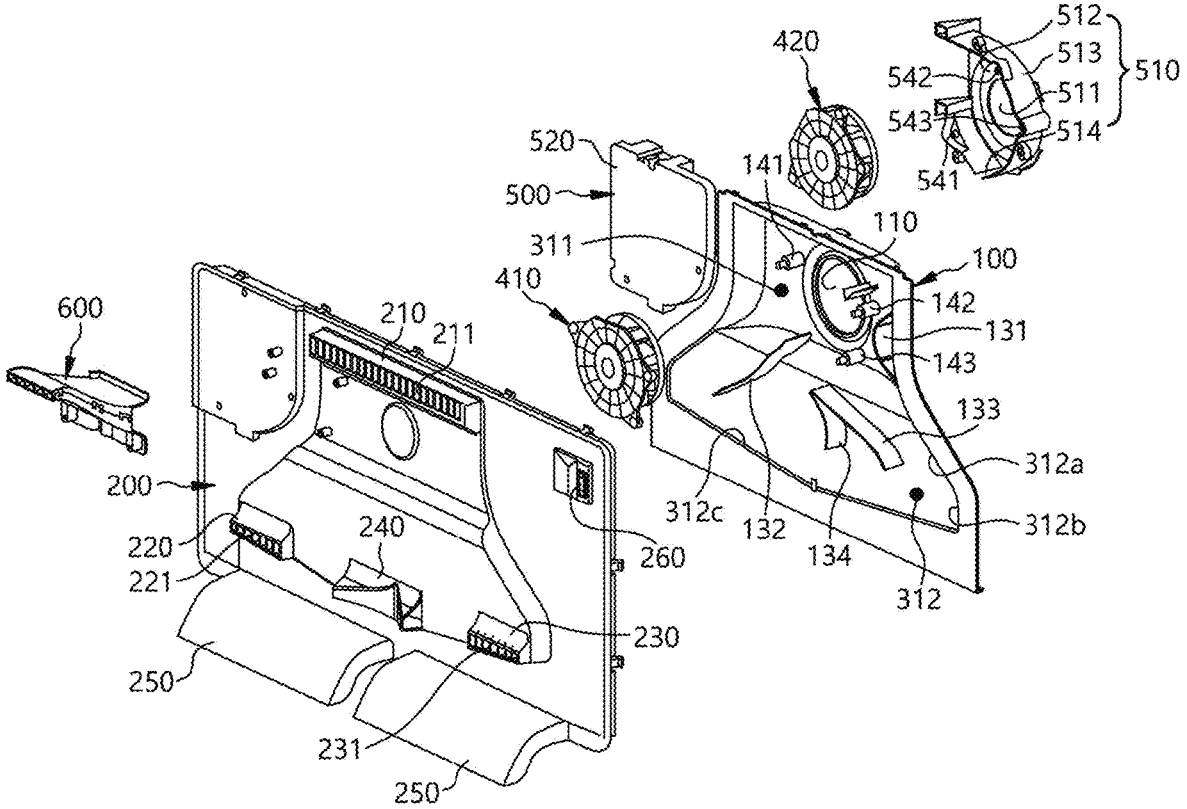
FIG. 7 is an exploded-perspective view showing an example of a grille panel assembly of the refrigerator.

As shown in FIG. 7, the refrigerator may have the grille panel assembly 1 including a shroud 100, a grille panel 200, a cool air flow path 300 for the storage compartment, a blower fan module 410, and a discharge guide duct 600.

The grille panel assembly 1 of the refrigerator will be described in detail for each configuration.

First, the shroud 100 will be described with reference to FIGS. 7 to 9.

FIG. 7 is an exploded-perspective view showing the grille panel assembly of the refrigerator. FIG. 8 is a front view showing the shroud of the refrigerator. FIG. 9 is a rear view showing the shroud of the refrigerator.

As shown in the drawings, the shroud 100 may provide a rear wall surface of the grille panel assembly 1.

In the rear wall surface in the cabinet 10, the second evaporator 32 may be positioned in rear of the freezing compartment 12, and the shroud 100 may be positioned in front of the second evaporator 32.

The shroud 100 may have an inlet hole 110 for the freezing compartment.

Cool air heat-exchanged while passing through the second evaporator 32 positioned in rear of the freezing compartment 12 may pass through the inlet hole 110 for the freezing compartment and may flow into a space between the grille panel 200 and the shroud 100. The blower fan module 410 may be installed in a portion of a front surface of the shroud 100, the portion where the inlet hole 110 for the freezing compartment is provided.

In particular, the inlet hole 110 for the freezing compartment may be positioned in a center side of the shroud 100 on the basis of the left and right of the shroud 100.

In addition, the inlet hole 110 for the freezing compartment may be positioned in an upper portion of the shroud 100 on the basis of the top and bottom of the shroud 100.

That is, since the inlet hole 110 for the freezing compartment is positioned in the center side of the shroud 100, cool air passing through the inlet hole 110 for the freezing compartment and rotating along a freezing fan 411 may be uniformly blown to the circumferential area of the freezing fan 411. Since the inlet hole 110 for the freezing compartment is positioned in the upper portion of the shroud 100, a position of the blower fan module 410 may be higher than the second evaporator 32.

However, when the position of the blower fan module 410 is aligned with the second evaporator 32 back and forth or partially overlapped, the storage space in the freezing compartment 12 may be inevitably reduced by the sum thickness of the front to rear thickness of the second evaporator 32 and the front to rear thickness of the blower fan module 410. In some implementations, the storage space of the freezing compartment 12 can be secured by arranging the second evaporator 32 and the blower fan module 410 not to be aligned back and forth.

Next, the grille panel 200 will be described with reference to FIGS. 5 and 10 to 15.

Figure 10:
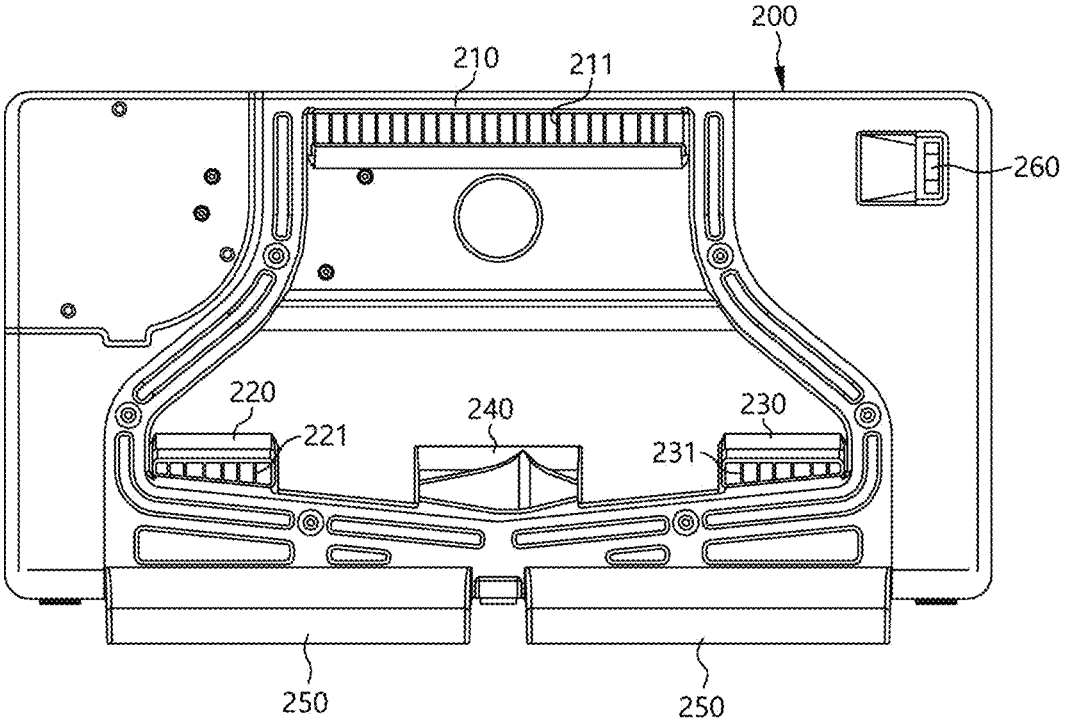
FIG. 10 is a front view showing an example of a grille panel of the refrigerator.
Figure 11:
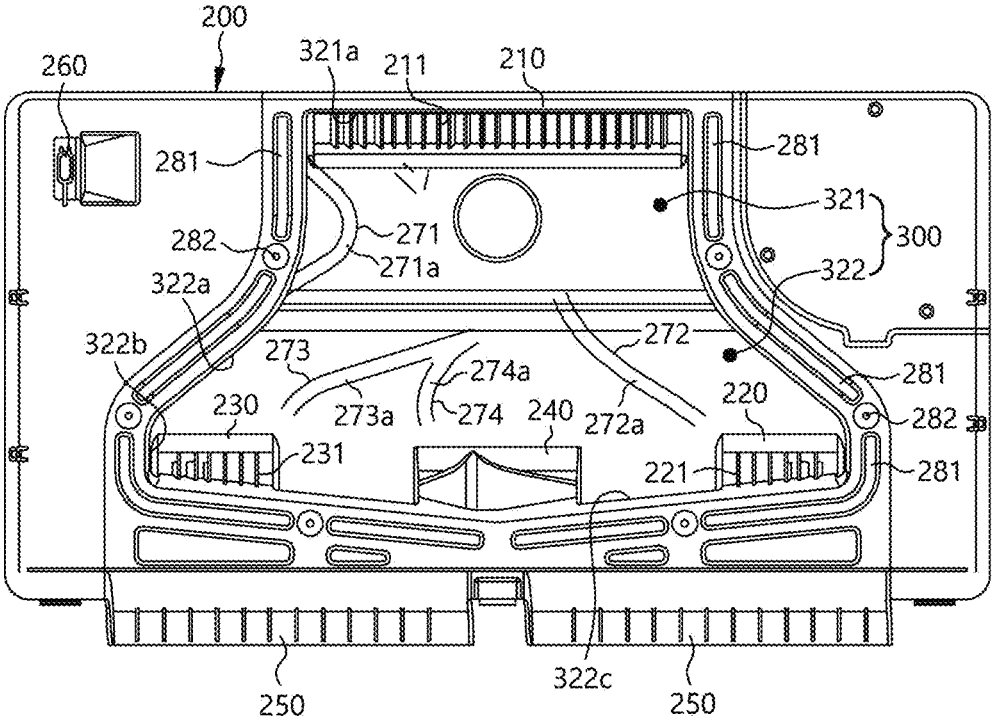
FIG. 11 is a rear view showing the grille panel of the refrigerator.
Figure 12:
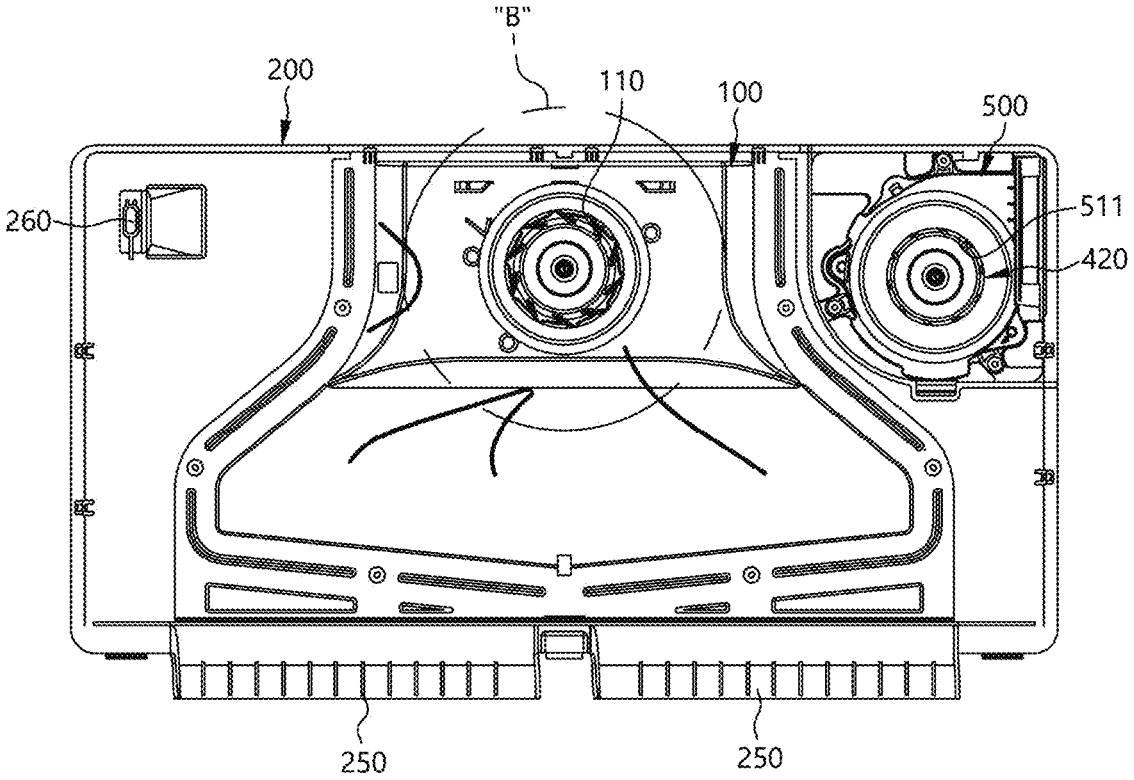
FIG. 12 is a rear view showing an example state in which fan modules and the shroud are coupled to the grille panel of the refrigerator.
Figure 13:
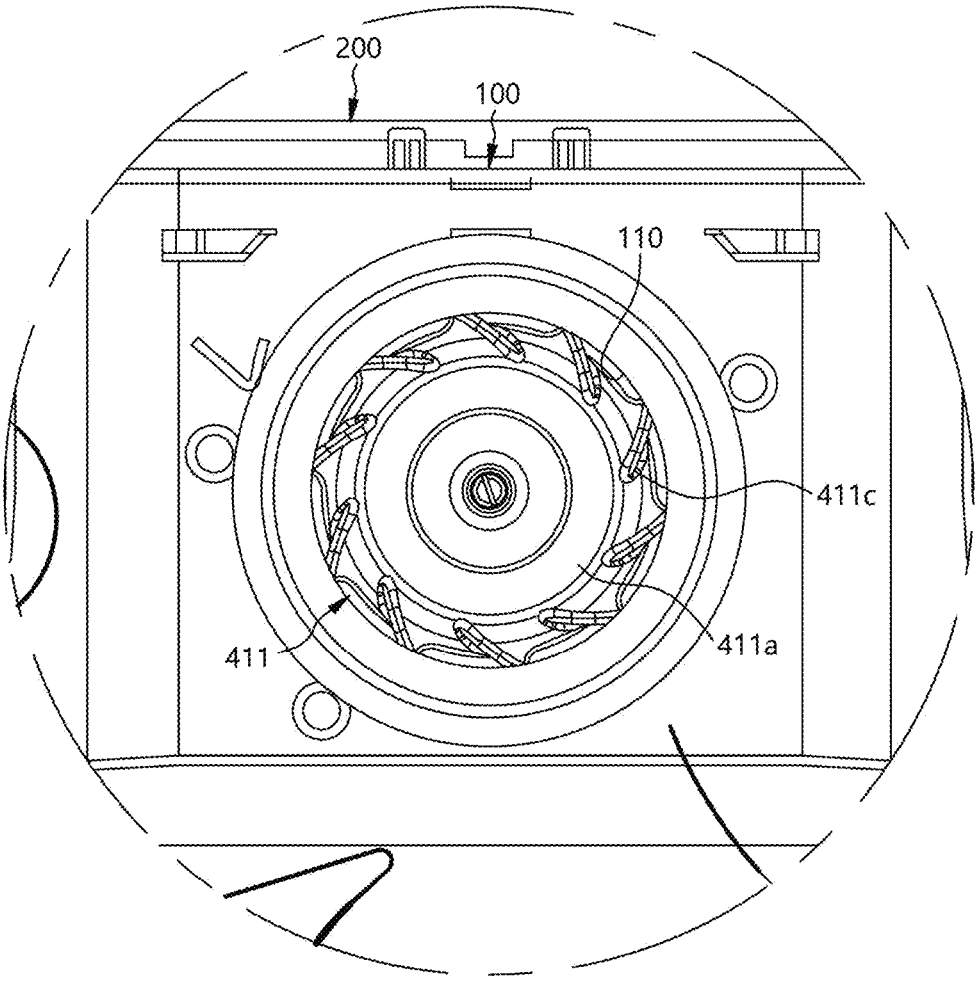
FIG. 13 is an enlarged view showing part "B" in FIG. 12.

FIG. 7 is an exploded-perspective view showing the grille panel assembly of the refrigerator. FIG. 10 is a front view showing the grille panel of the refrigerator. FIG. 11 is a rear view showing the grille panel of the refrigerator. FIG. 12 is a rear view showing a state in which each fan module and the shroud are coupled to the grille panel of the refrigerator.

As shown in the drawings, the grille panel 200 may be a portion forming a front wall surface of the grille panel assembly 1 and may be positioned in front of the shroud 100.

The grille panel 200 may be formed larger than the shroud 100. As the shroud 100 may be coupled to a rear surface of the grille panel 200, a gap is formed between the shroud 100 and the grille panel 200. The gap between the shroud 100 and the grille panel 200 may be used as the cool air flow path 300 for the storage compartment.

In particular, the shroud 100 may be formed such that an upper width thereof is narrower than a lower width thereof, thereby opposite upper corner portions of the grille panel 200 may remain as an empty space in which the shroud 100 does not exist. A temperature sensor 260 may be provided in either portion of the opposite corner portions of the grille panel 200, and a duct connection part 500 may be provided in the remaining portion of the opposite corner portions of the grille panel 200.

The temperature sensor 260 may detect the temperature in the freezing compartment 12.

Furthermore, the grille panel 200 may have the first cool air outlet 210.

The first cool air outlet 210 may be a portion that is open so as to supply cool air to the upper space in the freezing compartment 12.

In addition, the first cool air outlet 210 can be formed in a position higher than the blower fan module 410. For example, the first cool air outlet 210 can be positioned to be adjacent to an upper surface of the grille panel 200.

That is, since the first cool air outlet 210 may be positioned in the highest portion of the freezing compartment 12, even when the blower fan module 410 is positioned in an upper side in the shroud 100, cool air may be discharged efficiently through the first cool air outlet 210.

In some implementations, the first cool air outlet 210 can be formed such that a left to right length thereof is longer than that of the inlet hole 110 for the freezing compartment. In some examples, the first cool air outlet 210 can be defined to extend from a wall surface of one side of an inflow side flow path part formed in the grille panel 200 to a wall surface of another side thereof, so that cool air flowing along the upper surface of the grille panel 200 can be discharged efficiently through the first cool air outlet 210.

In particular, the first cool air outlet 210 may be formed in a tube body protruding forward. That is, cool air passing through the first cool air outlet 210 may have straightness, and as a result, the cool air passing through the first cool air outlet 210 may not spread upward and downward, but may be discharged straight forward, and may be supplied to a front side in the freezing compartment 12 (rear wall surface of freezing compartment door).

The first cool air outlet 210 may have a plurality of grill ribs 211.

Each of the grill ribs 211 may be a rib that guides a discharge direction of the cool air discharged through the first cool air outlet 210.

The grill ribs 211 may be arranged to be spaced apart from each other, and may be formed to face the front or to be inclined toward opposite sides of the first cool air outlet 210.

Furthermore, the grille panel 200 may have a second cool air outlet 220 and a third cool air outlet 230.

The second cool air outlet 220 and the third cool air outlet 230 may be portions that are open so that cool air is supplied to a middle space in the freezing compartment 12.

That is, considering that the first cool air outlet 210 is configured to supply cool air to the upper space in the freezing compartment 12, the middle space in the freezing compartment 12 may be in shorter supply of cool air than the upper space in the freezing compartment 12. Whereby, the second cool air outlet 220 and the third cool air outlet 230 are additionally provided, so that sufficient cool air may also be supplied to the middle space in the freezing compartment 12.

The second cool air outlet 220 and the third cool air outlet 230 may be formed along a lower surface 322*c* of an expansion side flow path part 322 (referring to FIG. 11) that may be formed in the side of the grille panel 200 in the cool air flow path 300 for the storage compartment, which will be described below.

That is, while the cool air flows along the lower surface 322*c* of the expansion side flow path part 322, the cool air flowing along the cool air flow path 300 for the storage compartment may be discharged to the freezing compartment 12 by passing through the second cool air outlet 220 and the third cool air outlet 230 in sequence.

The second cool air outlet 220 may be provided in one side of the expansion side flow path part 322 (right side in the drawing when the grille panel is viewed from the front). The third cool air outlet 230 may be provided in another side of the expansion side flow path part 322 (left side in the drawing when the grille panel is viewed from the front).

The first cool air outlet 210 may be formed larger than the combined size of the second cool air outlet 220 and the third cool air outlet 230. Whereby, most of the cool air blown by the blower fan module 410 may be supplied into the freezing compartment 12 through the first cool air outlet 210.

Grill ribs 221, 231 may be provided in each of the second cool air outlet 220 and the third cool air outlet 230.

The grill ribs 221, 231 may be a structure that gives a directionality to cool air discharged by passing through each of the second cool air outlet 220 and the third cool air outlet 230. In some examples, at least some of the grill ribs 221, 231 can be inclined to guide the cool air passing through the area (some of the grill ribs) toward a side portion in the freezing compartment 12.

In addition, the second cool air outlet 220 and the third cool air outlet 230 may be formed in tube bodies protruding forward.

That is, straightness may be given to the cool air passing through the two cool air outlets 220 and 230, and as a result, the cool air passing through the cool air outlets 220 and 230 may not spread upward and downward, but is discharged straight forward, and may be supplied to the front side in the freezing compartment 12.

In some examples, a fourth cool air outlet 240 may be provided between the second cool air outlet 220 and the third cool air outlet 230.

That is, while cool air flows along the cool air flow path 300 for the storage compartment on the grille panel side, the cool air may pass through the second cool air outlet 220, the fourth cool air outlet 240, and the third cool air outlet 230 in sequence to be additionally supplied to the freezing compartment 12.

In particular, the second cool air outlet 220 and the third cool air outlet 230 may be respectively positioned in end portions at opposite sides of the lower surface 322*c* of the expansion side flow path part 322.

The structure may allow the cool air discharged to the freezing compartment 12 to be sufficiently supplied to spaces of opposite sides in the freezing compartment. In the structure, the second cool air outlet 220 and the third cool air outlet 230 can be spaced apart from the fourth cool air outlet 240 as far as possible, so that the flow of cool air discharged from each cool air outlet 220, 230, 240 may not collide with each other.

In some examples, the fourth cool air outlet 240 may be formed in a tube body in which a front surface is closed and opposite side surfaces are open.

Figure 15:
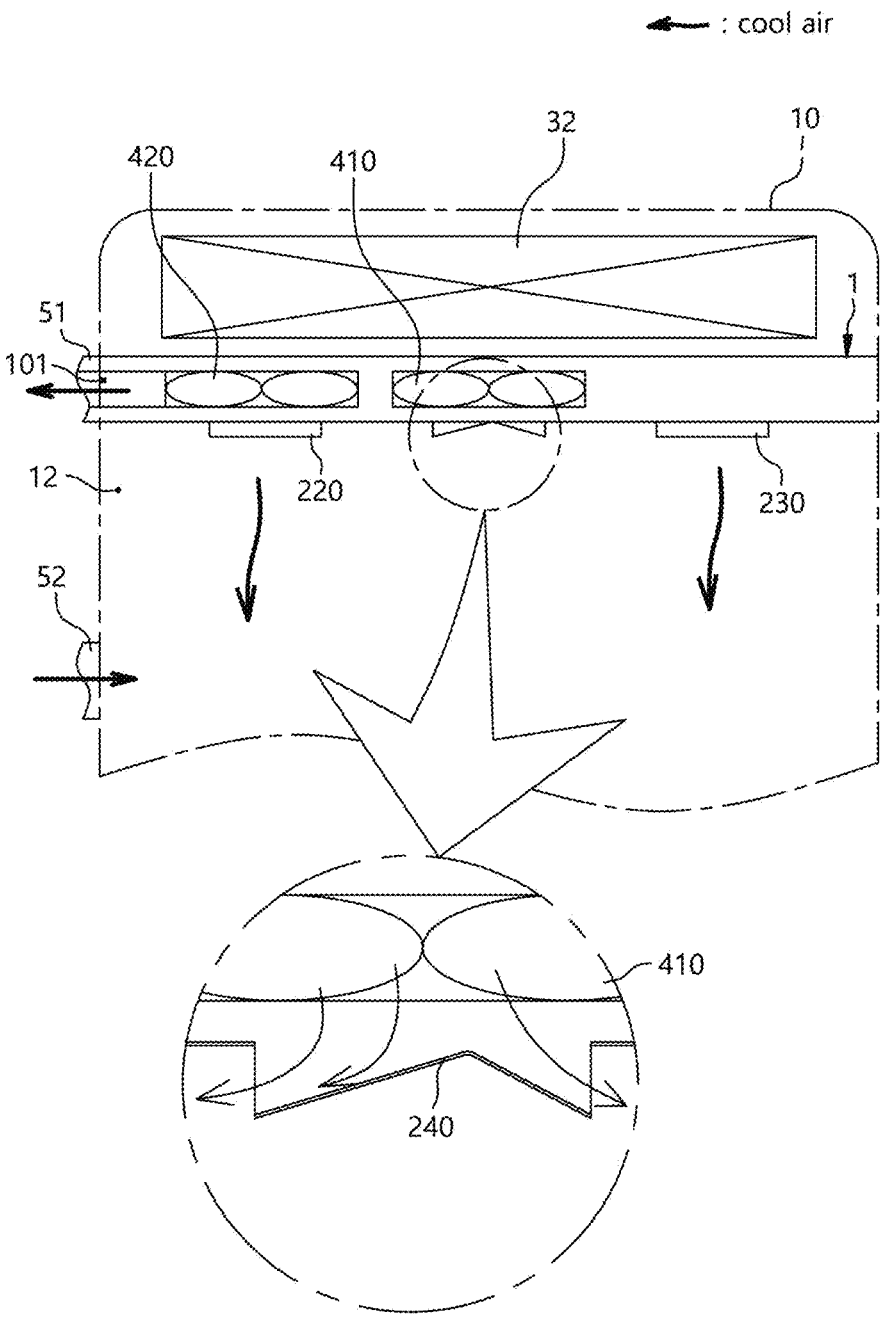
FIG. 15 a plan view schematically showing an example of cool air flow by each auxiliary cool air outlet of the refrigerator.

That is, the cool air passing through the fourth cool air outlet 240 may be discharged toward opposite side surfaces in the freezing compartment 12. Whereby, sufficient cool air may be supplied to the stored objects in opposite wall areas of the rear side in the freezing compartment 12. The structure is as shown in FIG. 15.

In some examples, the fourth cool air outlet 240 can be positioned in a different height from the second cool air outlet 220 and the third cool air outlet 230 to discharge cool air to a space corresponding to the height.

That is, when the fourth cool air outlet 240 is positioned at the same height as the second cool air outlet 220 or the third cool air outlet 230, the cool air discharged from the fourth cool air outlet 240 to both sides may collide with and interfere with the flow of the cool air discharged forward from the other auxiliary cool air outlets 220 and 230.

In some implementations, the fourth cool air outlet 240 can be defined in a center portion of the lower surface 322*c* of the expansion side flow path part 322. That is, considering that the center portion of the lower surface 322*c* of the expansion side flow path part 322 is lower than opposite ends, the fourth cool air outlet 240 may be provided in the center portion of the center portion of the lower surface 322*c* of the expansion side flow path part 322. The fourth cool air outlet 240 can help to prevent the cool air discharged through the fourth cool air outlet 240 from colliding with the flow of the cool air discharged forward through the other cool air outlet 220, 230.

Further, the grille panel 200 may have a suction guide 250 that guides the recovery flow of the cool air flowing through the freezing compartment 12.

The suction guide 250 can be provided in a lower end of the grille panel 200, and introduce the cool air recovered after circulating in the freezing compartment 12 into a lower end of the second evaporator 32.

In addition, the suction guide 250 may be formed to be inclined at an angle the same as (or similar to) a wall surface constituting a rear side lower portion of the freezing compartment 12 as the suction guide 250 goes to a lower end thereof. That is, the suction guide 250 may guide the cool air flowing along a lower surface in the freezing compartment 12 to flow efficiently to the lower end of the second evaporator 32.

Next, the cool air flow path 300 for the storage compartment will be described.

The cool air flow path 300 for the storage compartment may be a flow path that guides cool air passing through the inlet hole 110 for the freezing compartment formed in the shroud 100 and flowing into the space between the grille panel 200 and the shroud 100 to be supplied to the freezing compartment 12.

The cool air flow path 300 for the storage compartment may be formed by recessing at least one surface of facing surfaces between the shroud 100 and the grille panel 200.

In the implementation of present disclosure, the cool air flow path 300 for the storage compartment may be partially formed on both the facing surfaces between the shroud 100 and the grille panel 200.

That is, a part of the cool air flow path 300 for the storage compartment may be formed on the shroud 100 and other part thereof may be formed on the grille panel 200. In this way, the cool air flow path 300 for the storage compartment in an intact form may be formed between the shroud 100 and the grille panel 200 by coupling between the shroud 100 and the grille panel 200.

In some implementations, the cool air flow path 300 for the storage compartment can be formed only on the shroud 100 or only on the grille panel 200.

Figure 8:
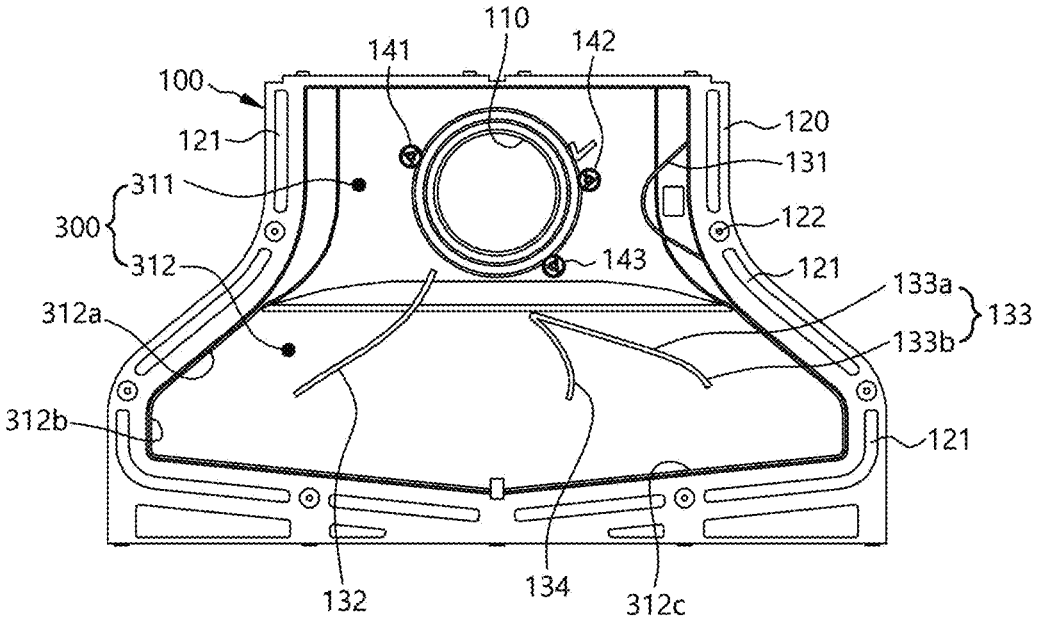
FIG. 8 is a front view showing an example of a shroud of the refrigerator.
Figure 9:
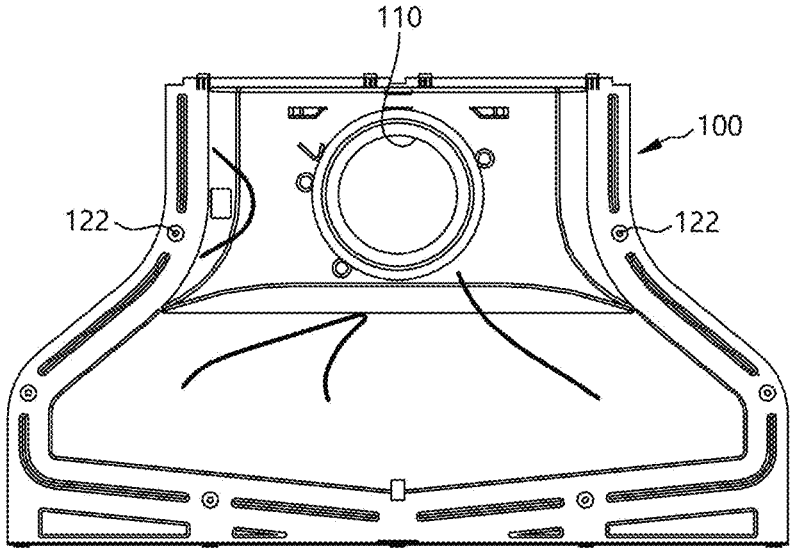
FIG. 9 is a rear view showing the shroud of the refrigerator.

As shown in FIGS. 8 and 11, the cool air flow path 300 for the storage compartment may include an inflow side flow path part 311, 321 and an expansion side flow path part 312, 322.

The blower fan module 410 may be installed in the inflow side flow path part 311, 321, and the expansion side flow path part 312, 322 may constitute a lower portion of the inflow side flow path part 311, 321 and may be formed to be more extended to both sides than the inflow side flow path part 311, 321.

In particular, an inflow side flow path part 311 formed on a front surface of the shroud 100 may be formed to protrude (or be recessed) more rearward from the shroud 100 than an expansion side flow path part 312 formed on the front surface of the shroud 100.

In addition, the expansion side flow path part 322 formed on the rear surface of the grille panel 200 may be formed to protrude (or be recessed) more forward from the grille panel 200 than an inflow side flow path part 321 formed on the rear surface of the grille panel 200.

That is, an upper surface of the second evaporator 32 positioned at the rear surface side of the shroud 100 may be positioned lower than the inlet hole 110 for the freezing compartment. Considering the structure, the inflow side flow path part 311, 321 may protrude more rearward than the expansion side flow path part 312, 322 to maximize the space in the freezing compartment 12, and the expansion side flow path part 322 may protrude more forward than the inflow side flow path part 321 to secure a space in which cool air flows.

In particular, the grille panel 200 may be formed in a plate shaped to cover both of the inflow side flow path part 321 and the expansion side flow path part 322. The grille panel 200 may be formed to protrude more forward in an area covering the expansion side flow path part 322 than in an area covering the inflow side flow path part 321.

The second evaporator 32 may be arranged in rear of the expansion side flow path part 322.

In addition, a boundary between the inflow side flow path part and the expansion side flow path part may be formed to be inclined or curved, so that cool air flowing through the inflow side flow path part of the shroud may be efficiently guided into the expansion side flow path part of the grille panel.

Furthermore, a lower surface 312*c*, 322*c* of the expansion side flow path part 312, 322 may be formed to be inclined downward from opposite ends of the expansion side flow path part 312, 322 toward the center thereof.

That is, cool air flowing through the cool air flow path 300 for the storage compartment in the same direction as a rotational direction of the freezing fan 411 may flow efficiently along a circumferential surface 312*a*, 312*b*, 322*a*, 322*b* and the lower surface 312*c*, 322*c* in the expansion side flow path part 312, 322.

In particular, the circumferential surface 312*a*, 312*b*, 322*a*, 322*b* in the expansion side flow path part 312, 322 may include an inclined side wall surface 312*a*, 322*a* and a vertical side wall surface 312*b*, 322*b*.

The inclined side wall surface 312*a*, 322*a* may be formed to be extended from the inflow side flow path part 311, 321 and be gradually inclined in an outward expanded shape. the vertical side wall surface 312*b*, 322*b* may be formed to be bent from an end of the inclined side wall surface 312*a*, 322*a* toward a lower portion of the cool air flow path and to be connected to the lower surface.

The inclined side wall surface 312*a*, 322*a* may be formed to be rounded, and the vertical side wall surface 312*b*, 322*b* may be formed to be inclined or rounded.

The shape of the expansion side flow path part 312, 322 may prevent or reduce flow resistance that may occur at a corner, and the flow of cool air supplied to the freezing compartment 12 may be increased.

In some examples, the first cool air outlet 210 may be positioned at an upper portion in the inflow side flow path part 321 formed in the grille panel 200.

In addition, the second cool air outlet 220 and the third cool air outlet 230 may be respectively positioned at the ends of the opposite sides of the lower surface 322*c* of the expansion side flow path part 322 formed in the grille panel 200. The fourth cool air outlet 240 may be positioned at the center portion of the lower surface 322*c* of the expansion side flow path part 322.

That is, each of the cool air outlets 210, 220, 230, and 240 may be formed at a portion where the flow of cool air changes, such as an upper edge, opposite side edges, and a lower edge, so that cool air may be efficiently discharged through each of the cool air outlets 210, 220, 230, and 240.

Furthermore, a guide 131, 132, 133, 134 may be provided at facing surfaces between the shroud 100 and the grille panel 200.

That is, the guide 131, 132, 133, 134 may guide cool air to flow toward each of the cool air outlets 210, 220, 230, and 240.

The guide 131, 132, 133, 134 may be formed on the front surface of the shroud 100.

The guide 131, 132, 133, 134 may include a first guide 131 that guides the flow of cool air to the first cool air outlet 210, a second guide 132 that guides the flow of cool air to the second cool air outlet 220, a third guide 133 that guides the flow of cool air to the third cool air outlet 230, and a fourth guide 134 that guides the flow of cool air to the fourth cool air outlet 240.

The first guide 131 may be formed to protrude from a center portion of any one side wall in the inflow side flow path part 311.

The second guide 132 may be formed to be inclined or rounded from any one circumference of the blower fan module 410 to the second cool air outlet 220.

The third guide 133 may be formed to be inclined or rounded from boundary between the inflow side flow path part 311 and the expansion side flow path part 312 to the third cool air outlet 230.

The fourth guide 134 may be formed to be inclined or rounded from the boundary between the inflow side flow path part 311 and the expansion side flow path part 312 to the fourth cool air outlet 240.

In addition, a receiving guide 271, 272, 273, 274 in which the guide 131, 132, 133, 134 is received may be formed on a rear surface of the grille panel 200.

The receiving guide 271, 272, 273, 274 may be configured to receive the guide 131, 132, 133, 134. Accordingly, the cool air flowing through the cool air flow path 300 for the storage compartment may be prevented from leaking between the guide 131, 132, 133, 134 and the grille panel 200.

In some examples, a coupling flange 120 may be provided at a circumference of the front surface of the shroud 100, and the coupling flange 120 may be coupled to the rear surface of the grille panel 200 while surface-contacting with the rear surface thereof.

In particular, a plurality of assembly ribs 121 may be formed by protruding forward from the coupling flange 120 and by being extended in parallel to the inclined side wall surface 312*a*, 322*a* and the vertical side wall surface 312*b*, 322*b*.

In addition, on the rear surface of the grille panel 200, a plurality of rib receiving grooves 281 may be formed by protruding rearward to receive the assembly ribs 121.

Therefore, the grille panel 200 may be assembled to the front of the shroud 100 and be in close contact with the shroud 100, so that cool air may be prevented from leaking toward the contact portion.

Fastening holes 122 and 282 may be respectively formed between each of the assembly ribs 121 and between each of the rib receiving grooves 281. The shroud 100 may be fixed to the grille panel 200 by screw-fastening in a state in which the fastening holes 122 and 282 match with each other.

Figure 17:
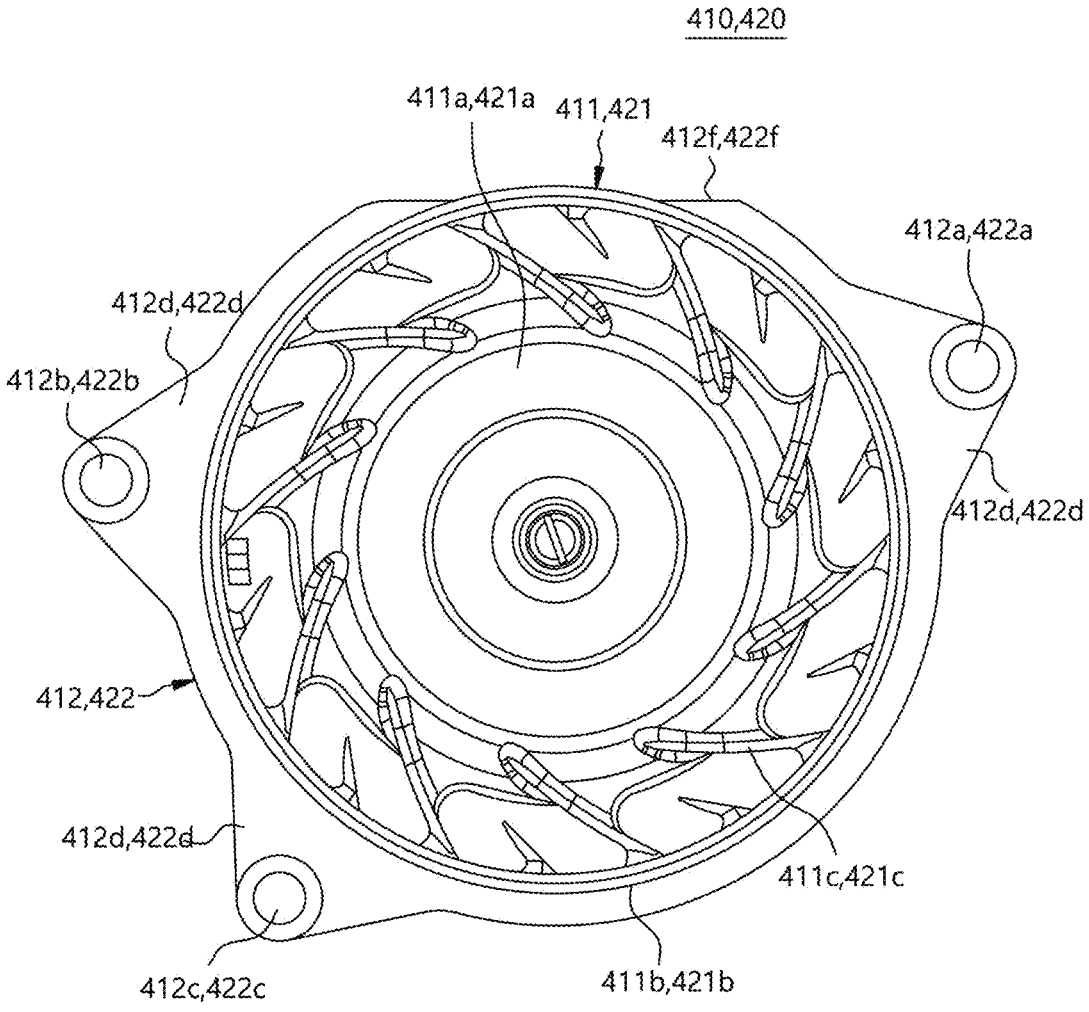
FIG. 17 is a front view showing the fan modules of the refrigerator.
Figure 18:
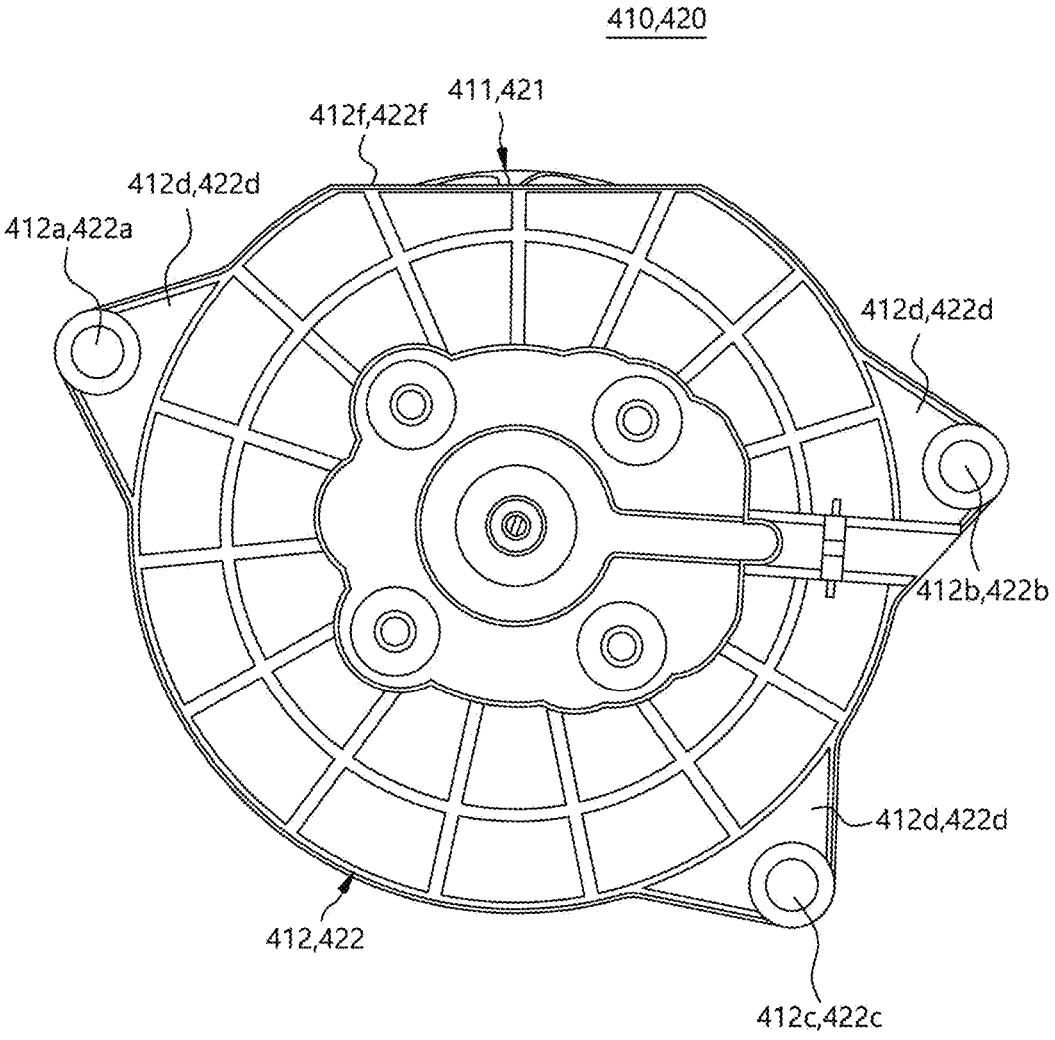
FIG. 18 is a rear view showing the fan modules of the refrigerator.

Next, the blower fan module 410 will be described with reference to FIGS. 16 to 18.

Figure 16:
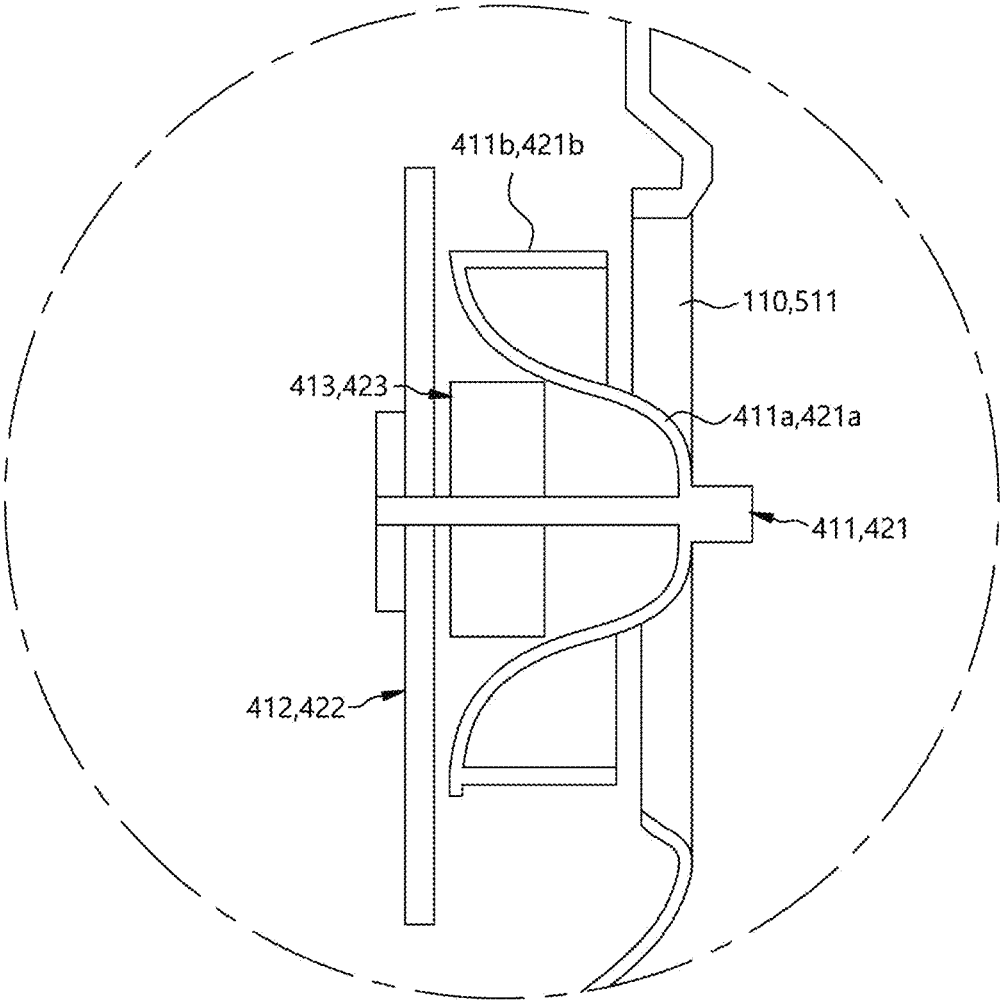
FIG. 16 is a view schematically showing an installation state of an example blower fan module and an example ice-making fan module of the refrigerator.

FIG. 16 is a view schematically showing an installation state of the blower fan module and an ice-making fan module of the refrigerator. FIG. 17 is a front view showing the fan modules of the refrigerator. FIG. 18 is a rear view showing the fan modules of the refrigerator.

As shown in the drawings, cool air may pass through the second evaporator 32 by the blower fan module 410 to be blown to the cool air flow path 300 for the storage compartment.

The blower fan module 410 may be positioned to face the inlet hole 110 for the freezing compartment of the shroud 100 and may be installed in the shroud 100.

The blower fan module 410 may include the freezing fan 411 and a first installation frame 412.

The freezing fan 411 may be formed of a slim centrifugal fan, thereby reducing the thickness of the grille panel assembly 1 (width in the front to rear direction).

The freezing fan 411 may include a hub part 411*a*, a rim part 411*b*, and a plurality of impellers 411*c*.

The hub part 411*a* may be a portion that is shaft-coupled to a fan motor 413, and may be formed by protruding forward (in a direction toward the cool air inflow side) as the hub part 411*a* goes to the center thereof and may be enlarged as the hub part 411*a* goes to a rear end thereof. The fan motor 413 may be positioned inside the hub part 411*a*.

The rim part 411*b* may be formed to surround a circumference of the hub part 411*a*.

The impellers 411*c* may be formed integrally with the hub part 411*a* and may be arranged to be spaced apart from each other. In addition, the impellers 411*c* may be formed to have a predetermined inclination (or curvature), and may be configured to allow cool air to pass through a gap between the impellers.

Furthermore, the first installation frame 412 may be formed of a first plane constituting a front wall surface thereof, a second plane constituting a rear wall surface, and a circular plate of a predetermined thickness having a circumferential surface connecting the two planes together.

A plurality of protrusions 412*d* may be formed by protruding radially from a circumference of the first installation frame 412. The protrusions 412*d* may have fastening holes 412*a*, 412*b*, and 412*c*, respectively.

The fastening holes 412*a*, 412*b*, and 412*c* may be aligned with each of fastening protrusions 141, 142, and 143 provided on the shroud 100 and then may be fastened with bolts or screws.

The hub part 411*a* may be rotatably coupled the second plane of the first installation frame 412.

The fastening protrusions 141, 142, and 143 may be provided in positions considering the size and wind direction of the freezing fan 411, and an installation direction of the first installation frame 412 may vary as the positions of the fastening protrusions 141, 142, and 143.

In addition, a cut part 412*f* may be formed on a circumferential surface of the first installation frame 412. The cut part 412*f* may be formed in a shape cut from the basic circle constituting the first installation frame 412.

Figure 14:
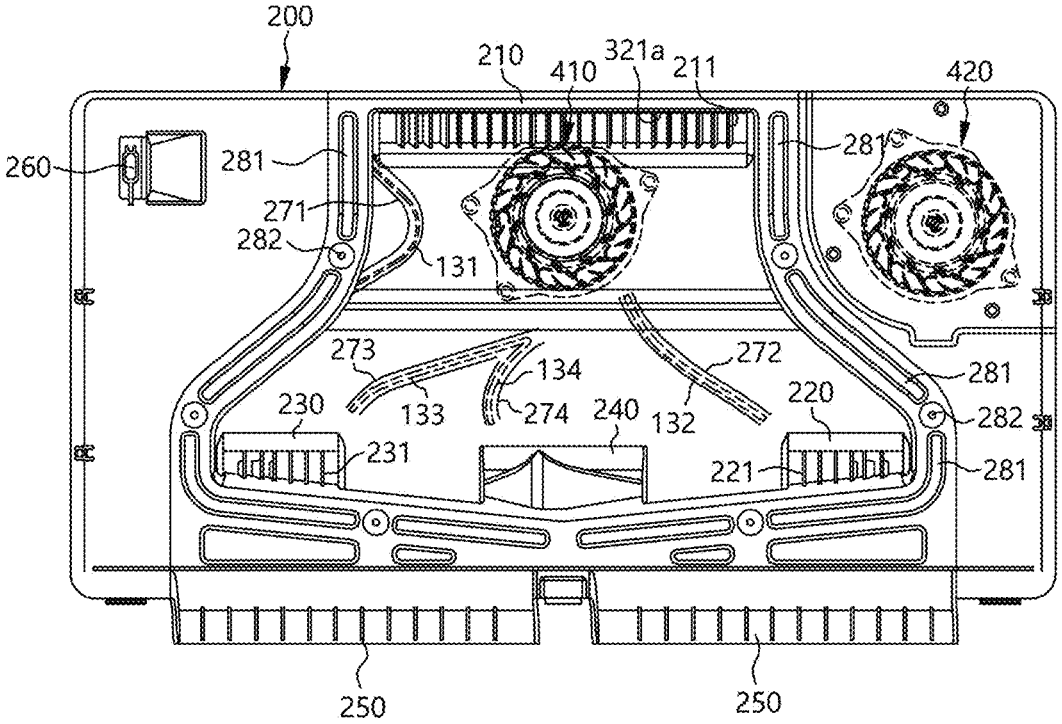
FIG. 14 is a rear view showing an example of a state in which fan modules are coupled to the grille panel and air guides are received in receiving ribs.

The cut part 412*f* may be mounted to face upward in a state in which the first installation frame 412 is coupled to the shroud 100. That is, as shown in FIG. 14, the cut part 412*f* may be positioned at a portion facing the first cool air outlet 210.

In some examples, the refrigerator can include an ice-making fan module 420.

Therefore, cool air passing through the second evaporator 32 may be blown to the cool air duct 51 for the ice-making compartment by the ice-making fan module 420.

The ice-making fan module 420 may be installed inside the duct connection part 500, and may include a blower fan 421 (hereinbelow, the blower fan 421 refers to "the ice-making fan") and a second installation frame 422.

The ice-making fan 421 may be formed of a slim centrifugal fan, thereby reducing the thickness of the grille panel assembly 1 (width in the front to rear direction).

The ice-making fan 421 may include a hub part 421*a*, a rim part 421*b*, and a plurality of impellers 421*c*.

The hub part 421*a* may be shaft-coupled to a fan module 423, and may be formed by protruding forward (in a direction toward the cool air inflow side) as the hub part 421*a* goes to the center thereof and may be enlarged as the hub part 421*a* goes to a rear end thereof. The fan module 423 may be positioned inside the hub part 421*a*.

The rim part 421*b* may be formed to surround a circumference of the hub part 421*a*.

The impellers 421*c* may be formed integrally with the hub part 421*a* and may be arranged to be spaced apart from each other. In addition, the impellers 421*c* may be formed to have a predetermined inclination (or curvature), and may be configured to allow cool air to pass through a gap between the impellers. The size of the impellers 421*c* may be the same as the size of the impellers 411*c* of the ice-making fan.

In particular, the ice-making fan 421 may be configured as a fan of the same size as the freezing fan 411 of the blower fan module 410. That is, the ice-making fan 421 and the freezing fan 411 (or, the ice-making fan module and the blower fan module) may be used in common, so that the standardization of product design may be achieved through the common use of fan modules.

Furthermore, the second installation frame 422 may be formed of a first plane facing a duct body 520 of the duct connection part 500, a second plane facing a duct housing 510 of the duct connection part 500, and a circular plate of a predetermined thickness having a circumferential surface connecting the two planes together.

A plurality of protrusions 422*d* may be formed by protruding radially from a circumference of the second installation frame 422. The protrusions 422*d* may have fastening holes 422*a*, 422*b*, and 422*c*, respectively.

The fastening holes 422*a*, 422*b*, and 422*c* may be aligned with each of fastening protrusions 541, 542, and 543 formed on the duct connection part 500 and then may be fastened with bolts or screws.

The hub part 421*a* can be rotatably coupled to the second plane of the second installation frame 422.

The fastening protrusions 541, 542, and 543 may be provided in positions considering the size and wind direction of the ice-making fan 421, and an installation direction of the second installation frame 422 may vary as the positions of the fastening protrusions 541, 542, and 543.

A cut part 422*f* may be formed on a circumferential surface of the second installation frame 422.

In some examples, the ice-making fan module 420 may be installed inside the duct connection part 500. Cool air blown by the operation of the ice-making fan module 420 may pass through the second evaporator 32, flow into the duct connection part 500, and then flow to the cool air duct 51 for the ice-making compartment.

The duct connection part 500 may be arranged in a space formed by a rear wall of freezing compartment and the inclined side wall surfaces 312*a* and 322*a* of the shroud 100 and the grille panel 200.

In particular, the duct connection part 500 may be positioned at a side portion of the inflow side flow path part 311, 321 and the inclined side wall surface 312*a*, 322*a* of the shroud 100.

In particular, a lower portion of the duct connection part 500 may be positioned at the side portion of the inclined side wall surface 312*a*, 322*a*.

That is, the duct connection part 500 is arranged in an empty space in which the shroud 100 is not installed in the rear surface of the grille panel 200, so that the grille panel assembly 1 may be compact.

The duct connection part 500 may include the duct housing 510 and the duct body 520.

The duct housing 510 may include a body wall 512 having an inlet hole 511 for the ice-making compartment, and a circumferential wall 513 surrounding a circumference of the body wall 512.

Cool air passing through the second evaporator 32 may pass through the inlet hole 511 for the ice-making compartment and then flow into the duct housing 510.

In some examples, the inlet hole 110 for the freezing compartment may be designed in consideration of air volume of cool air supplied through the blower fan module 410 to the freezing compartment 12. The inlet hole 511 for the ice-making compartment may be designed in consideration of pressure of cool air supplied through the ice-making fan module 420 to the ice-making compartment 21.

In some examples, where the blower fan module 410 supplies cool air to the freezing compartment 12 positioned in front thereof, the blower fan module 410 can supply a large amount of cool air. In the case of the ice-making fan module 420, where the ice-making fan module 420 supplies cool air to the ice-making compartment 21 positioned at the refrigerating compartment door 20, the ice-making fan module 420 can supply cool air far away.

In some implementations, the freezing fan 411 of the blower fan module 410 and the ice-making fan 421 of the ice-making fan module 420 can use the same fan for common use of products. In some examples, as shown in FIG. 12, the inlet hole 110 for the freezing compartment and the inlet hole 511 for the ice-making compartment may have different opening widths, so that the cool air supply to the freezing compartment 12 and the cool air supply to the ice-making compartment 21 may be differently performed.

For example, the inlet hole 110 for the freezing compartment may be formed relatively larger than the inlet hole 511 for the ice-making compartment, so that the compression force is weak, but a large amount of cool air may be discharged. The inlet hole 511 for the ice-making compartment may be formed relatively smaller than the inlet hole 110 for the freezing compartment, so that the discharge amount of cool air is small, but a high compression force enough to supply cool air to the ice-making compartment 21 may be obtained.

A plurality of fastening protrusions 541, 542, and 543 that are coupled to the second installation frame 422 may be formed by protruding from a front surface of the body wall 512.

The circumferential wall 513 of the duct housing 510 may be formed in a round shape to surround the ice-making fan module 420 and may be formed to be open in a tangential direction at one side thereof. The cool air duct 51 for the ice-making compartment may be connected to the open portion of the circumferential wall 513.

That is, the cool air flowing through the inlet hole 511 for the ice-making compartment into the duct housing 510 may flow along the inside of the circumferential wall 513 by the operation of the ice-making fan module 420, and then be discharged to the cool air duct 51 for the ice-making compartment.

In addition, a drain hole 514 may be formed in the circumferential wall 513 to discharge condensed water generated therein (or flowing into the inside). The drain hole 514 may be formed by opening a lower end of the circumferential wall 513.

Furthermore, the duct body 520 may be a portion that closes the duct housing 510 from the external environment, and may be configured to cover the duct housing 510 and be fastened to the duct housing 510 with screws.

In addition, the duct body 520 may be coupled and fixed to the grille panel 200. For example, the duct housing 510 can be fastened integrally by a screw that is provided for coupling between the duct body 520 and the grille panel 200.

Next, the discharge guide duct 600 will be described with reference to FIGS. 19 to 24.

Figure 19:
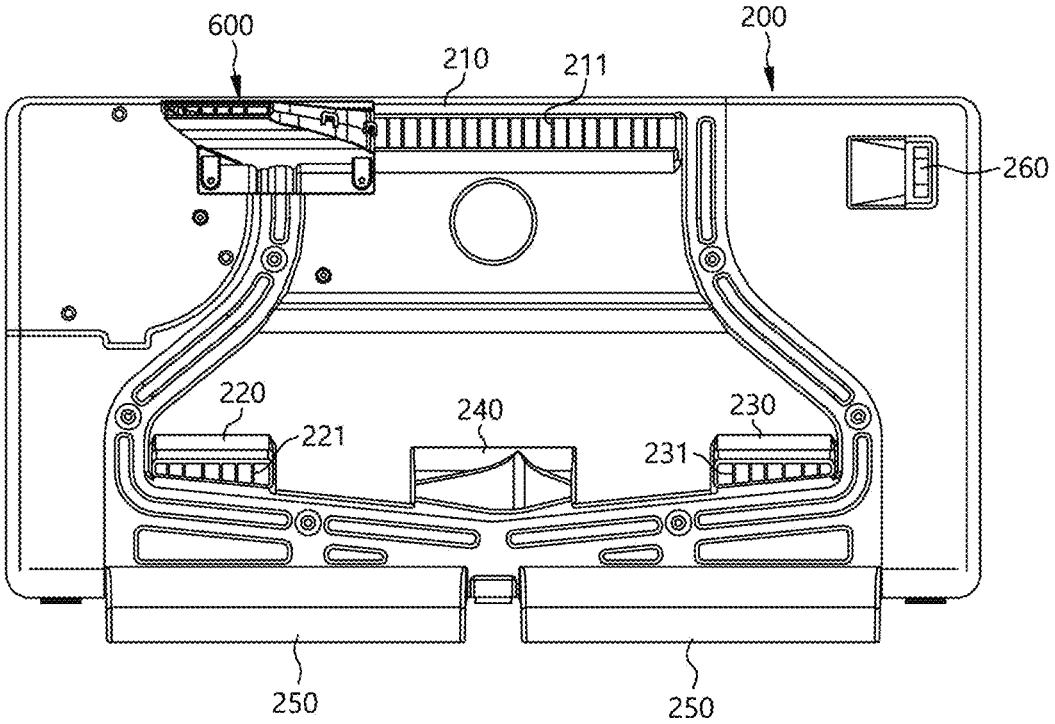
FIG. 19 is a front view showing an example of a discharge guide duct of the refrigerator.

FIG. 19 is a front view showing a state in which the discharge guide duct of the refrigerator is installed.

Figure 20:
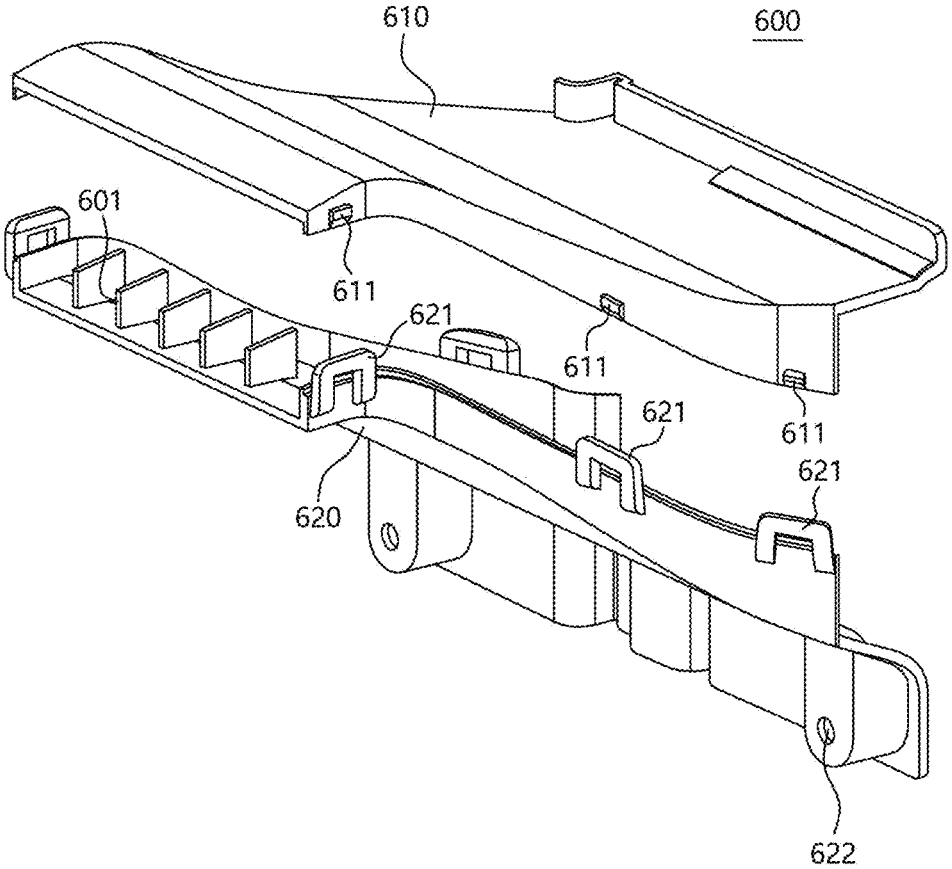
FIG. 20 an exploded-perspective view showing the discharge guide duct.
Figure 21:
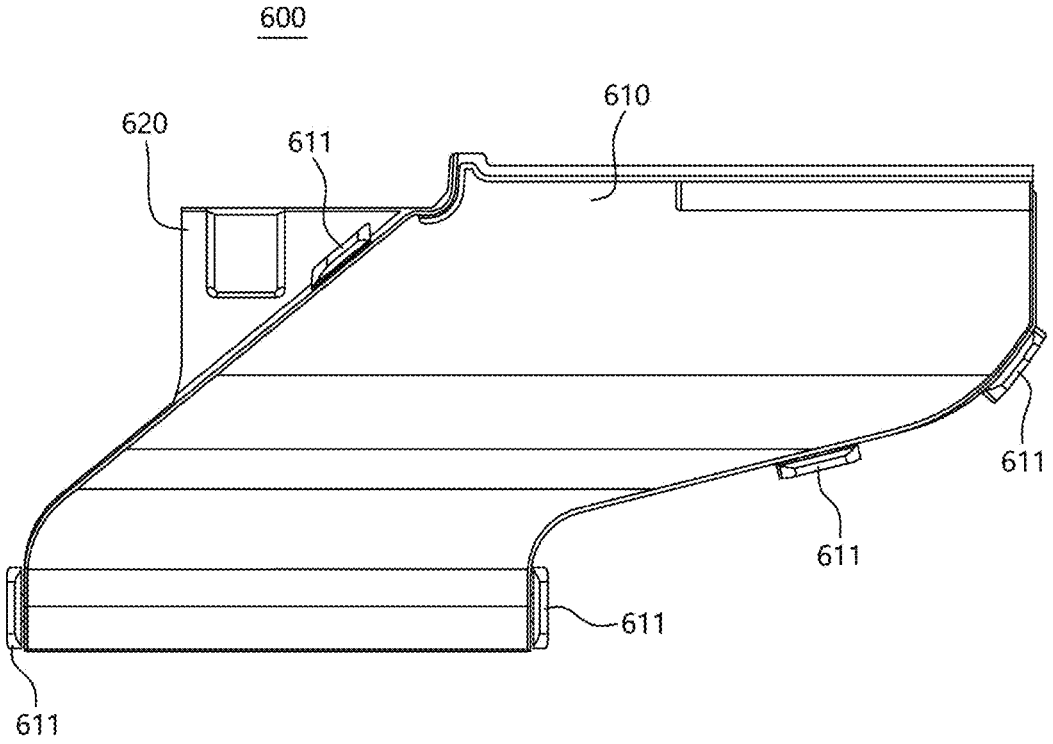
FIG. 21 is a plan view showing the discharge guide duct.
Figure 22:
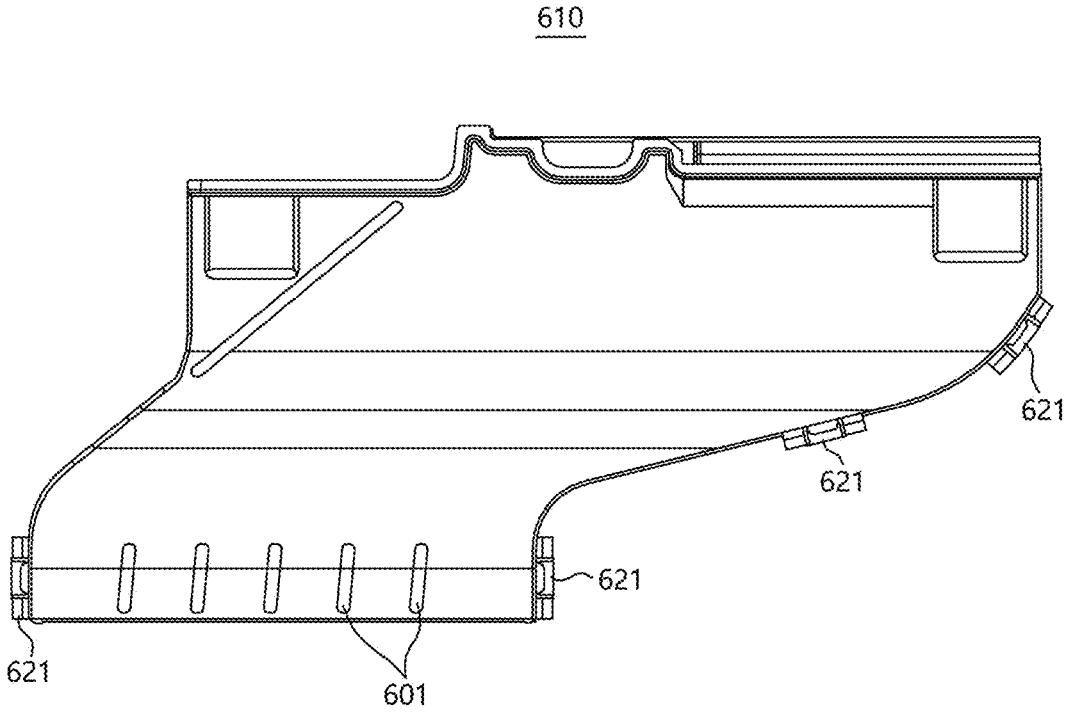
FIG. 22 is a plan view showing an internal structure of an example of a lower tube body of the discharge guide duct.
Figure 23:
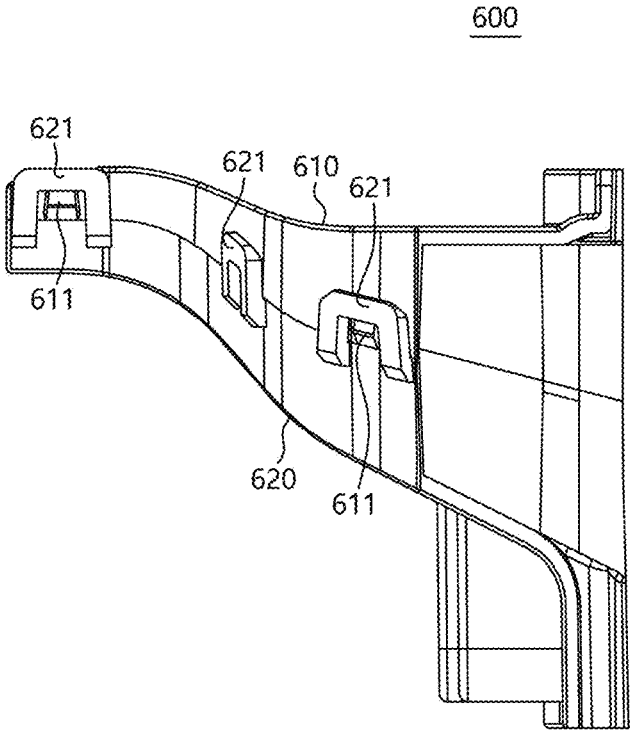
FIGS. 23 and 24 are side views showing the discharge guide duct.
Figure 24:
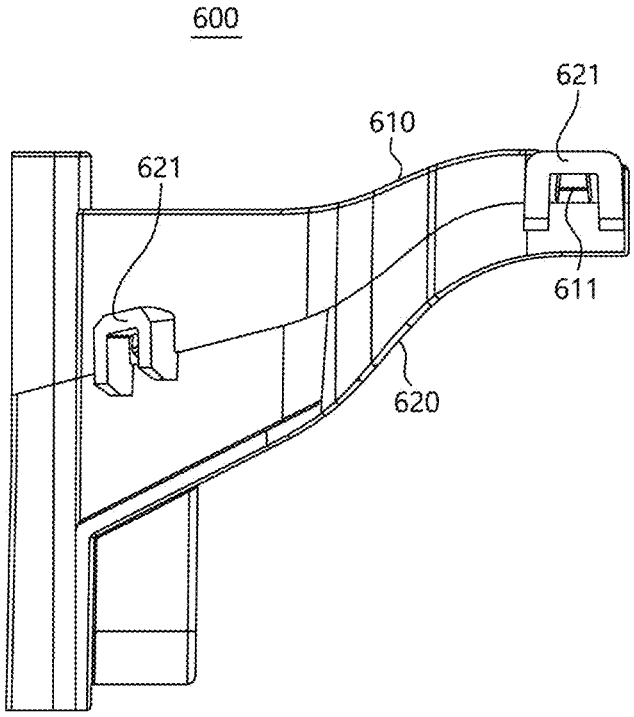
Figure 25:
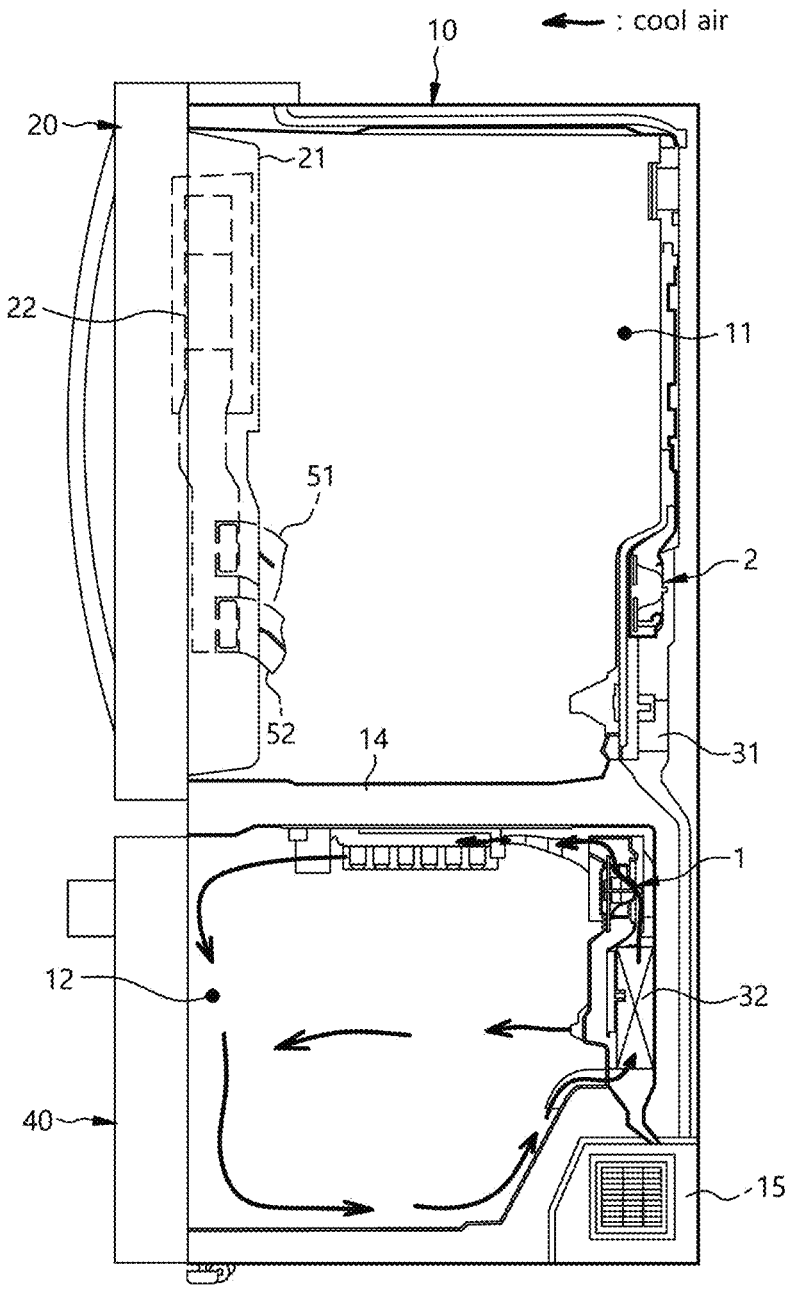
FIG. 25 is a side section view showing an example of flow of cool air during the freezing operation in a freezing compartment.
Figure 26:
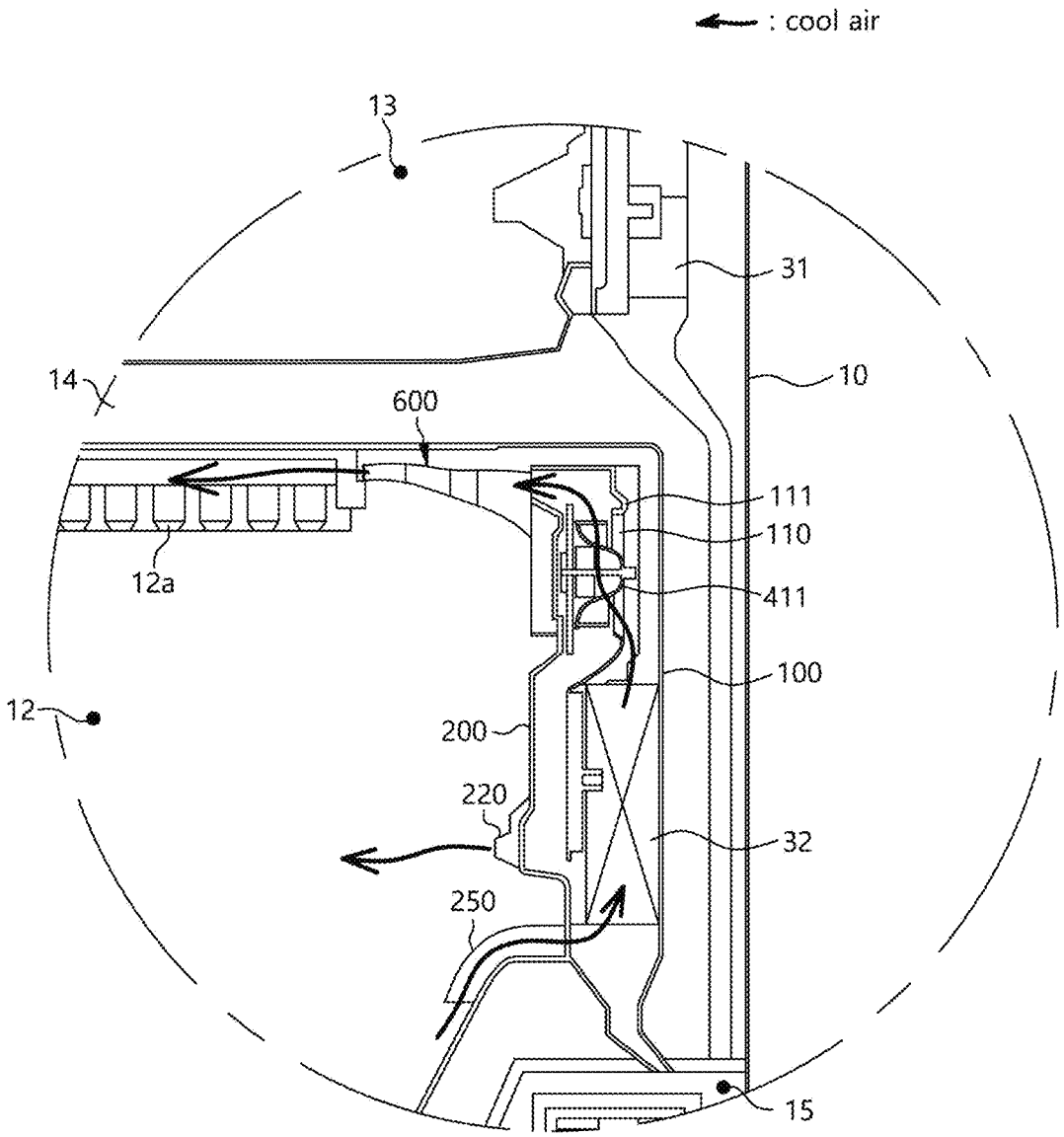
FIG. 26 is an enlarged view showing an example of flow of cool air during the freezing operation in the freezing compartment.
Figure 27:
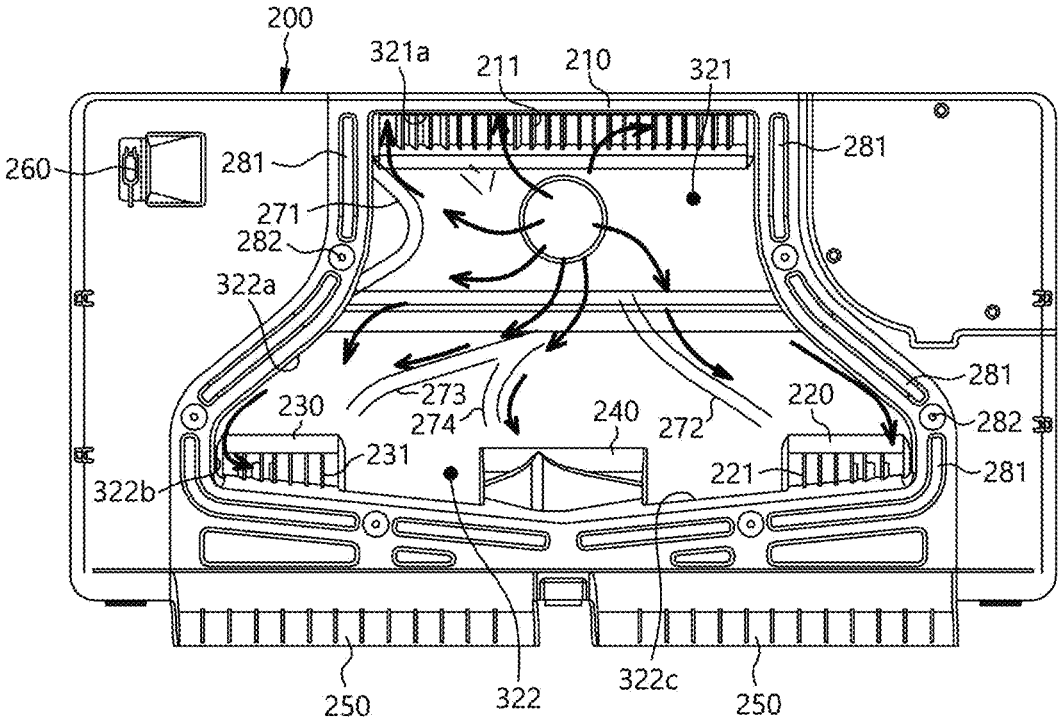
FIG. 27 is a rear view of the grille panel showing an example of flow of cool air during the freezing operation in the freezing compartment.
Figure 28:
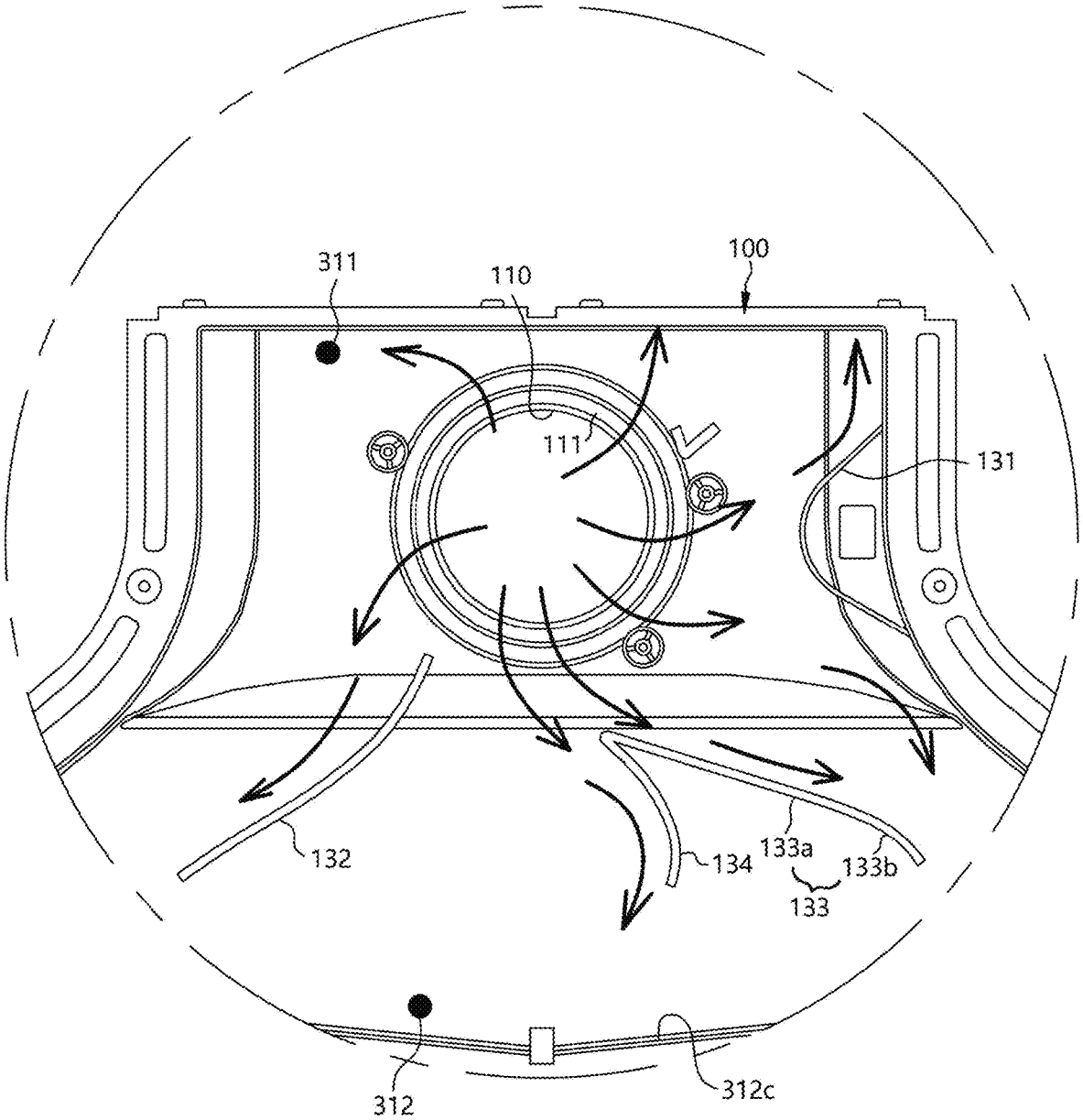
FIG. 28 is an enlarged view showing an example of flow of cool air at an inflow side flow path part in the shroud during the freezing operation in the freezing compartment.
Figure 29:
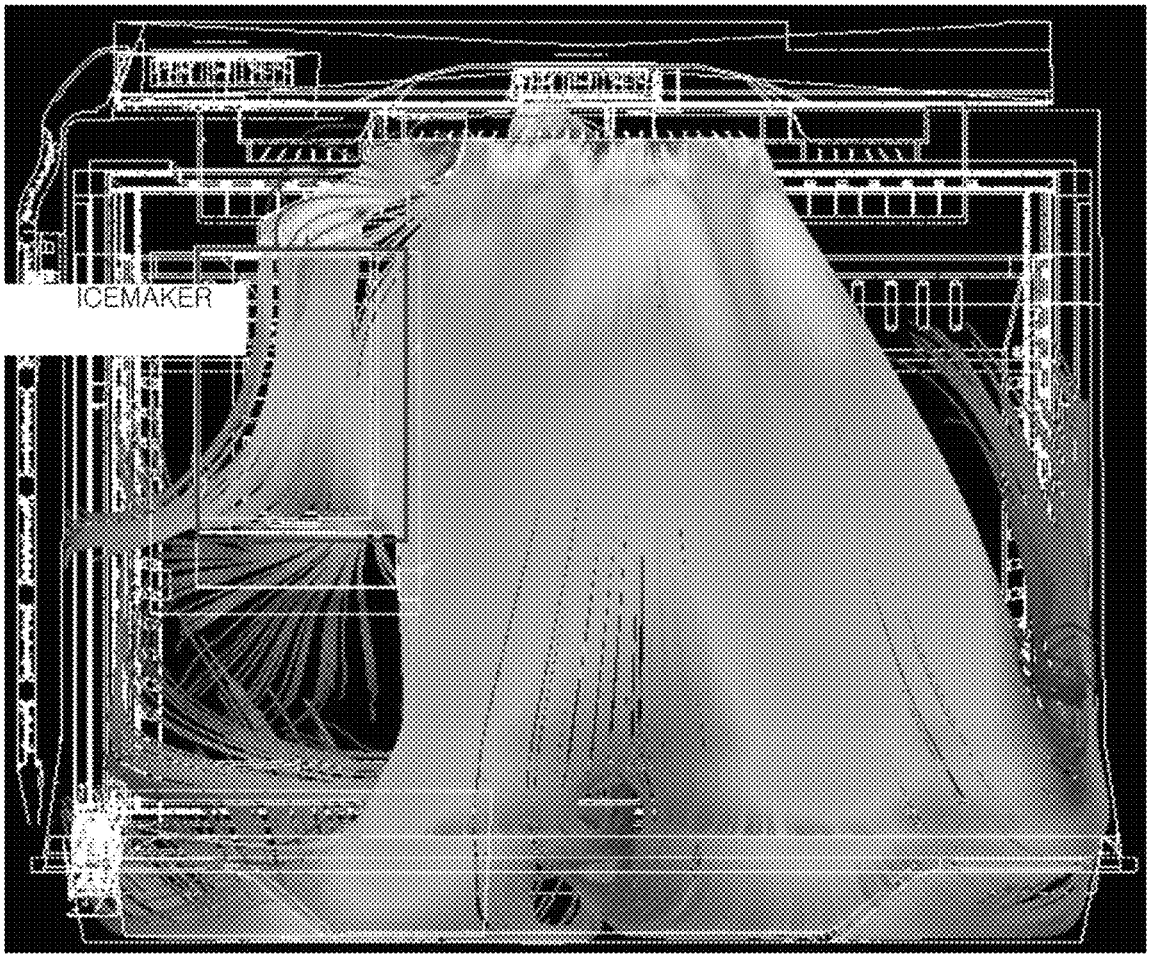
FIG. 29 a reference view showing an example state in which cool air is supplied to an ice maker during the freezing operation in the freezing compartment.

FIG. 20 an exploded-perspective view showing the discharge guide duct of the refrigerator. FIG. 21 is a plan view showing the discharge guide duct of the refrigerator. FIG. 22 is a plan view showing an internal structure of a lower tube body of the discharge guide duct of the refrigerator. FIGS. 23 and 24 are side views showing the discharge guide duct of the refrigerator.

The discharge guide duct 600 may serve to guide a discharge position (or direction) of cool air discharged from the first cool air outlet 210 to the freezing compartment 12.

In particular, the discharge guide duct 600 may be configured to concentrate the discharge of cool air to the ice maker 12*a* in the freezing compartment 12. That is, the cool air supply to the ice maker 12*a* may be continuously concentrated, so that the quality of ice made in the ice maker 12*a* may be improved.

The discharge guide duct 600 may be provided in front of the grille panel 200 and be formed in a hollow tube. That is, the flow direction of the cool air may be guided along the discharge guide duct 600.

Furthermore, the discharge guide duct 600 may be installed to surround at least a part of the first cool air outlet 210. The above structure may be provided for only part of the cool air discharged through the first cool air outlet 210 to be guided by the discharge guide duct 600.

That is, since the discharge guide duct 600 is configured to receive a part of the cool air passing through the first cool air outlet 210 and to guide the flow of the cool air, the cool air may be sufficiently supplied to the front of the first cool air outlet 210 or in a direction that is not guided by the discharge guide duct 600 (direction opposite to the side where the ice maker is positioned).

In some implementations, a rear end portion of the discharge guide duct 600 (cool air inlet portion) can surround a part of either end of the first cool air outlet 210.

Through the above structure, the cool air supplied to the freezing compartment 12 through the first cool air outlet 210 is not affected by the flow from the cool air discharged through the discharge guide duct 600. Therefore, the cool air supplied to the freezing compartment 12 through the first cool air outlet 210 may be evenly supplied to the entire area within the freezing compartment 12.

The rear end portion of the discharge guide duct 600 may be configured to wrap a front side circumference of the first cool air outlet 210. That is, a part of the first cool air outlet 210 may be received in the rear end portion of the discharge guide duct 600. Accordingly, the cool air discharged through the first cool air outlet 210 may be fully guided by the discharge guide duct 600 without external leakage.

In some examples, coupling between the discharge guide duct 600 and the first cool air outlet 210 can be achieved in a fitting manner. Therefore, when the discharge guide duct 600 and the first cool air outlet 210 are coupled to each other, an installation position of the discharge guide duct 600 may be precisely guided. In addition, it may be easy to perform coupling or separating thereof.

In addition, the discharge guide duct 600 may be configured to be removable, so that the discharge guide duct 600 may be replaced with a discharge guide duct of a different type (different shape) in response to the needs of the user or the type or position of the ice maker 12*a*.

Furthermore, the discharge guide duct 600 may be formed in a tube body protruding forward from the first cool air outlet 210. The structure may be provided to guide the cool air discharged through the first cool air outlet 210 and the discharge guide duct 600 to be supplied intensively and sufficiently to the front space in a storage compartment 12.

That is, even when the ice maker 12*a* is positioned in a front portion in the freezing compartment 12, the cool air passing through the first cool air outlet 210 may be continuously supplied to the ice maker 12*a* by guidance of the discharge guide duct 600.

In some implementations, a cool air outlet side of the discharge guide duct 600 can have a length enough to be positioned adjacent to a rear surface of the ice maker 12*a*.

Furthermore, the discharge guide duct 600 may be formed such that a duct line thereof becomes narrower toward the front. That is, through the structure, part of the cool air passing through the first cool air outlet 210 may flow into the discharge guide duct 600 and then be sprayed intensively toward a specific position (ice maker).

The structure for forming the duct line to be gradually narrowed may be variously formed. That is, as the discharge guide duct 600 goes toward the front, the discharge guide duct 600 may be configured to have a top to bottom width that gradually decreases, or to have a left to right width that gradually decreases.

For example, as the discharge guide duct 600 goes toward the front, a lower surface of the discharge guide duct 600 may be formed to be gradually inclined upward (or rounded), and one side surface of the discharge guide duct 600 may to be formed to be gradually inclined (or rounded) to be adjacent to another side surface thereof. The structure is the same as the structure shown in the implementation.

In some implementations, both upper and lower surfaces of the discharge guide duct 600 can be formed (inclined or rounded) to direct to a center portion thereof as the discharge guide duct 600 goes toward the front, and both left and right side surfaces of the discharge guide duct 600 may be formed (inclined or rounded) to direct to the center portion thereof as the discharge guide duct 600 goes toward the front. The structure in which a flow path is narrowed as the upper and lower surfaces or left and right side surfaces of the discharge guide duct 600 goes toward the center portion may be applied when the stored object for continuous cool air supply is positioned in front of the first cool air outlet 210 (especially in front of the center side of the first cool air outlet 210).

In addition, the discharge guide duct 600 may be formed to direct outward as the discharge guide duct 600 goes to the front. That is, since the discharge guide duct 600 is formed to be away from the first cool air outlet 210 as the discharge guide duct 600 goes to the front, it is possible to prevent or reduce occurrence of flow resistance when the cool air discharged through other portions (portions not wrapped in the discharge guide duct) of the first cool air outlet 210 collides with the discharge guide duct 600.

A cool air inlet side of the discharge guide duct 600 may be formed to be inclined by the inclination angle formed by each of the grill ribs 211 of the first cool air outlet 210, so that the cool air passing through the grill ribs 211 may flow efficiently along an inner wall surface of the discharge guide duct 600. That is, it is possible to prevent (or to minimize or reduce) flow resistance occurring in the cool air inlet side of the discharge guide duct 600, so that cool air may flow efficiently.

In some implementations, the front end of the discharge guide duct 600 can be formed (formed in a round or bent shape) to direct to the front. That is, the cool air discharged from the discharge guide duct 600 may be concentrically discharged to the ice maker 12*a* positioned at the front thereof without spreading to the side.

In addition, grill ribs 601 may be provided in an inside surface of the front end of the discharge guide duct 600. That is, through the additional formation of the grill ribs 601, the discharge direction of the cool air passing through the discharge guide duct 600 may be determined.

In some examples, the discharge guide duct 600 may be formed separately into upper and lower portions (referring to FIG. 19).

That is, considering that the discharge guide duct 600 is configured as a vertical tilt (inclination or round) structure and a lateral tilt structure, difficulty in injection molding may be caused. Accordingly, the discharge guide duct 600 may be formed separately into the upper and lower portions to enable injection molding for each portion.

The discharge guide duct 600 may be separated into an upper tube body 610 having an open lower surface and a lower tube body 620 having an open upper surface.

One side surface of the upper tube body 610 and one side surface of the lower tube body 620 may be formed to be open, and be configured to receive the first cool air outlet 210 in the open portions. Another side surface of the upper tube body 610 and another side surface of the lower tube body 620 may be formed to be closed, and be configured to surround an outer wall surface of the end side of the first cool air outlet 210.

In particular, locking protrusions 611 and locking hooks 621 that is configured to be engaged with each other may be respectively provided in facing surfaces (or facing portions) between the upper tube body 610 and the lower tube body 620. Accordingly, the upper tube body 610 and the lower tube body 620 may be coupled to each other and be configured integrally into a single body.

In addition, fastening holes 622 may be formed in a lower portion of the lower tube body 620. The fastening holes 622 may be holes provided for screw-fastening to the grille panel 200.

Hereinbelow, a process for controlling the temperature in each storage compartment 12, 21 by the operation of the above-described grille panel assembly 1 of the refrigerator will be described in detail.

First, a process for controlling the temperature in the freezing compartment 12 will be described with reference to FIGS. 25 to 28.

The temperature control of the freezing compartment 12 may be performed by the operations of the blower fan module 410 and a compressor. That is, through the rotation of the freezing fan 411 by supplying power to the blower fan module 410 and the heat-exchange operation of the second evaporator 32 by the operation of the compressor, the operation for controlling the temperature in the freezing compartment 12 may be performed.

When the freezing fan 411 of the blower fan module 410 is operated, air in the freezing compartment 12 may flow to pass through the second evaporator 32 by air blowing force of the freezing fan 411, and be heat-exchanged while passing through the second evaporator 32.

Furthermore, the heat-exchanged air (cool air) may pass through the inlet hole 110 for the freezing compartment of the shroud 100, enter the cool air flow path 300 for the storage compartment, and then flow toward each wall surface in the cool air flow path 300 for the storage compartment while rotating along a circumference of the freezing fan 411. Continuously, the cool air may flow along each wall surface in the cool air flow path 300 for the storage compartment and be supplied into the freezing compartment 12 through each of the cool air outlets 210, 220, 230, and 240 formed on the grille panel 200.

The cool air flowing toward an upper wall surface in the cool air flow path 300 for the storage compartment may be supplied to the upper space of the freezing compartment 12 through the first cool air outlet 210.

In addition, the cool air flowing toward the circumferential surface 312*a*, 312*b*, 322*a*, 322*b* and the lower surface 312*c*, 322*c* in the cool air flow path 300 for the storage compartment may flow along the circumferential surface 312*a*, 312*b*, 322*a*, 322*b* and the lower surface 312*c*, 322*c* in the cool air flow path 300 for the storage compartment. While the cool air flows along each surface or wall 312*a*, 312*b*, 322*a*, 322*b*, 312*c*, 322*c* in the cool air flow path 300 for the storage compartment, the cool air may pass through the second cool air outlet 220, the fourth cool air outlet 240, and the third cool air outlet 230 sequentially that are formed along the lower surface 312*c*, 322*c* in the cool air flow path 300 for the storage compartment and be supplied into the middle space of the freezing compartment 12.

About over half the cool air passing through the inlet hole 110 for the freezing compartment may be discharged through the first cool air outlet 210 into the upper space of the freezing compartment 12. The remaining cool air may be discharged through the second cool air outlet 220, the fourth cool air outlet 240, and the third cool air outlet 230 into the middle space of the freezing compartment 12.

Cool air that is not yet discharged into the middle space of the freezing compartment 12 through the second cool air outlet 220, the fourth cool air outlet 240, and the third cool air outlet 230 may be again circulated to a place where the first cool air outlet 210 is positioned.

Furthermore, when the cool air passes through each cool air outlet and is supplied into the freezing compartment 12, each grill rib 211, 221, 231 formed in each cool air outlet 210, 220, 230, 240 may guide the cool air. That is, the cool air may be evenly discharged to the entire area in the freezing compartment 12 by each grill rib 211, 221, 231.

In particular, since the lower surface 312*c*, 322*c* (lower surface of expansion side flow path part) of the cool air flow path 300 for the storage compartment is formed to be inclined (or rounded), the cool air passing through the second cool air outlet 220 may flow efficiently into the fourth cool air outlet 240 and the third cool air outlet 230 while flowing along the lower surface 312*c*, 322*c* of the cool air flow path 300 for the storage compartment.

Therefore, the even supply of cool air may be provided to both the upper and middle spaces and both the opposite side spaces of the freezing compartment 12.

In some examples, part of the cool air that flowing through the cool air flow path 300 for the storage compartment and is discharged through the first cool air outlet 210 into the freezing compartment 12 may be introduced into the discharge guide duct 600 installed at the first cool air outlet 210. Continuously, the cool air may flow along the discharge guide duct 600 and be supplied into the freezing compartment 12.

While the cool air flows along the discharge guide duct 600, the flow rate may gradually increase and the cool air may be concentrated in a specific direction. That is, since a flow path of the discharge guide duct 600 is formed to gradually narrow as the discharge guide duct 600 goes from the side where the cool air is introduced from the first cool air outlet 210 to the cool air discharge side, the flow rate of cool air may be gradually fast and concentrated.

Since the cool air discharge side of the discharge guide duct 600 is formed to be bent (or inclined or rounded) and to protrude (protrude forward) so as to be positioned adjacent to the rear surface of the ice maker 12*a*, the cool air may be continuously sprayed from the direct rear of the ice maker 12*a* toward the ice maker 12*a*. The operation may be confirmed through the cool air flow shown in FIG. 29.

Thus, ice making using the ice maker 12*a* may be efficiently performed and ice of excellent quality may be made.

In addition, the cool air may flow by receiving the guidance of each of the grill ribs 601 formed in the cool air discharge side of the discharge guide duct 600. For example, the cool air may be intensively supplied to a specific portion in the rear surface of the ice maker 12*a* by the grill ribs 601, and the cool air may be evenly supplied to the entire area of the rear surface of the ice maker 12*a*.

Furthermore, cool air may be supplied through a portion excluding the portion covered by the discharge guide duct 600 in the first cool air outlet 210 toward the front thereof and any one side (side opposite to the ice maker). Considering that the discharge guide duct 600 is positioned at either end of the first cool air outlet 210 and is formed to be inclined outward as the discharge guide duct 600 goes forward, the cool air supplied toward the front of the first cool air outlet 210 and any one side thereof may be efficiently discharged to the freezing compartment 12 without being affected by the discharge guide duct 600.

When the freezing operation in which cool air is supplied to the freezing compartment 12 is performed, the temperature sensor 260 installed in the grille panel 200 may continuously check the temperature in the freezing compartment 12. As a result, when it is determined that the temperature in the freezing compartment 12 is lower than a preset temperature (when preset temperature condition is satisfied), the supply of cool air may be controlled to be stopped while the operations of the freezing fan 411 and the freezing cycle are stopped.

When the temperature in the freezing compartment 12 rises above the preset temperature, the freezing fan 411 and the freezing cycle may be operated again and cool air may be supplied into the freezing compartment 12.

Accordingly, the temperature in the freezing compartment 12 may be controlled by the repeated circulation of air (cool air) described above.

Figure 30:
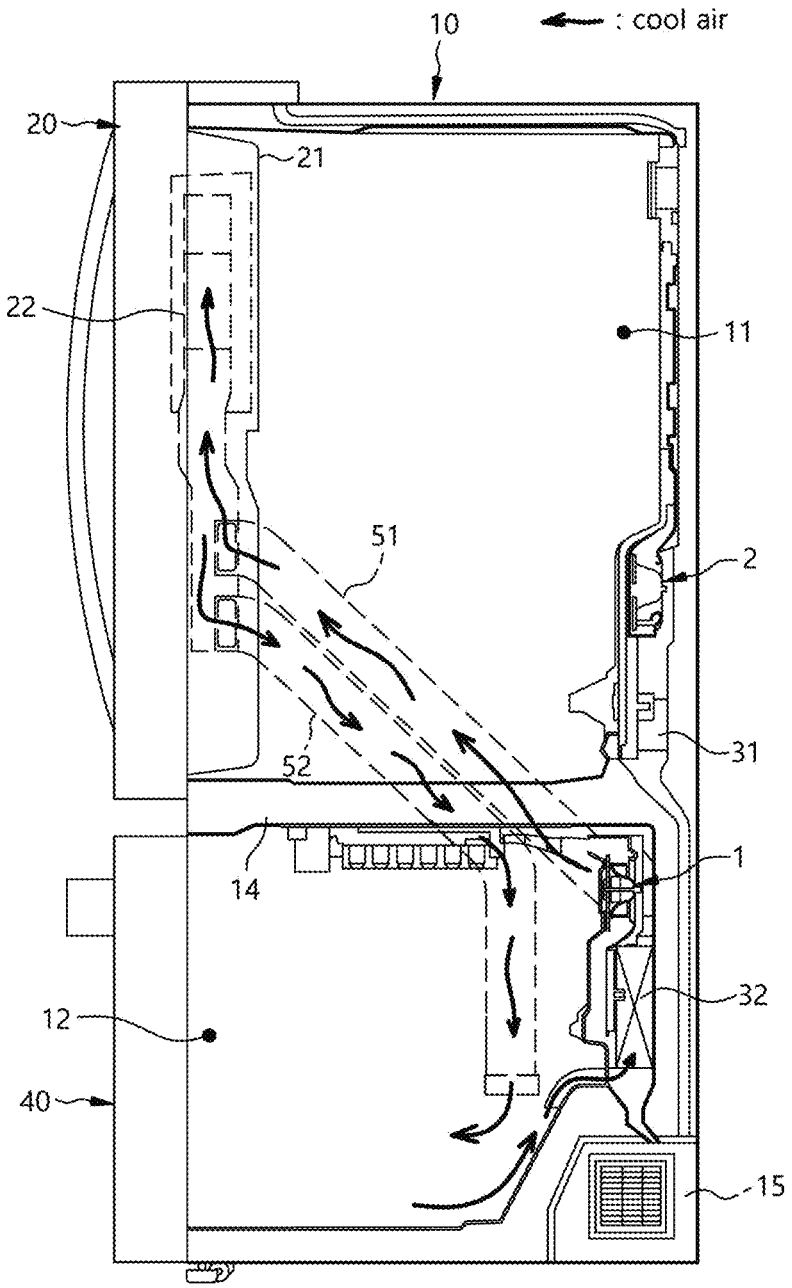
FIG. 30 is a side section view showing an example of flow of cool air during the freezing operation in an ice-making compartment.
Figure 31:
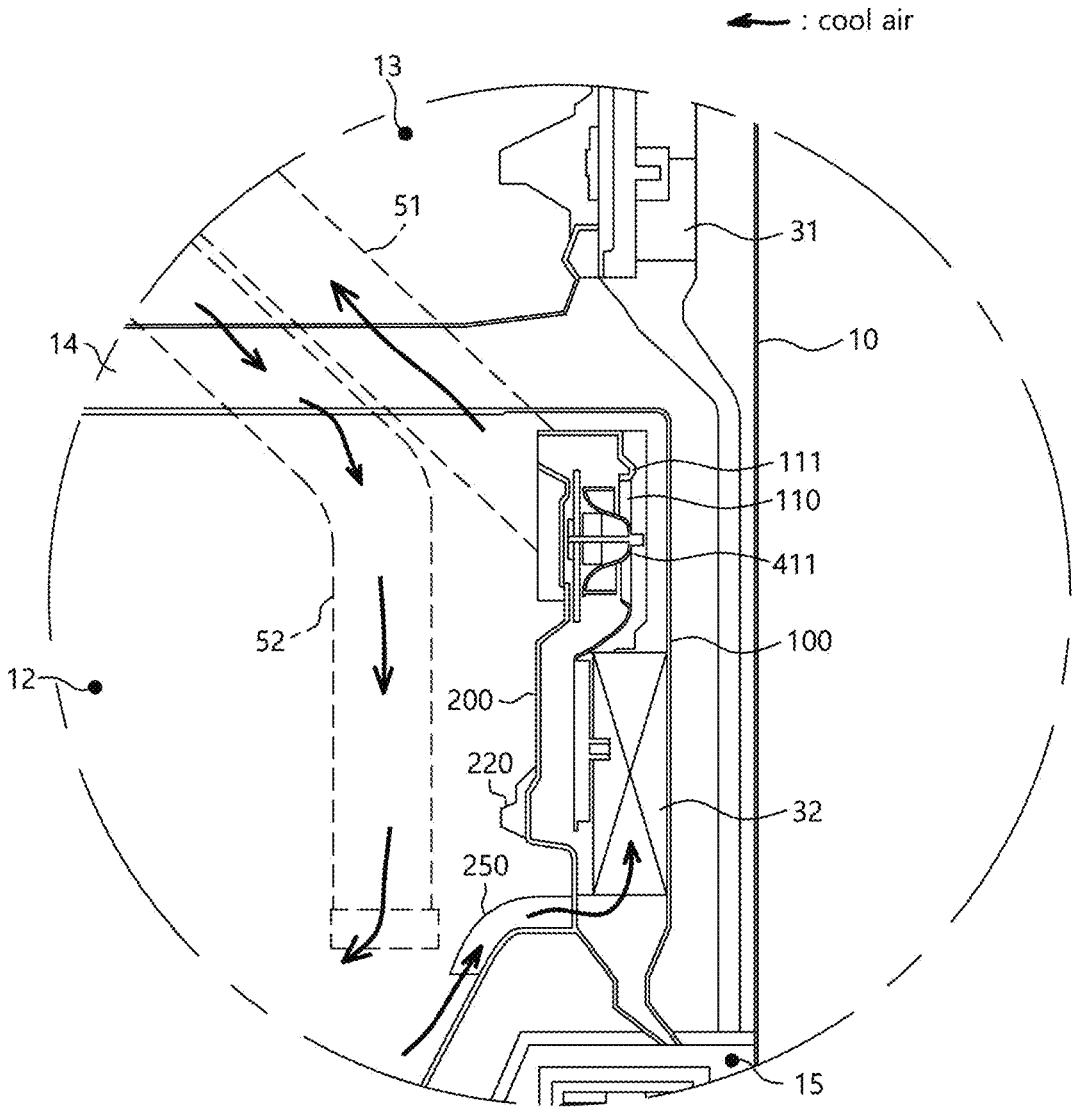
FIG. 31 is an enlarged view showing an example of flow of cool air when the freezing operation in the ice-making compartment.
Figure 32:
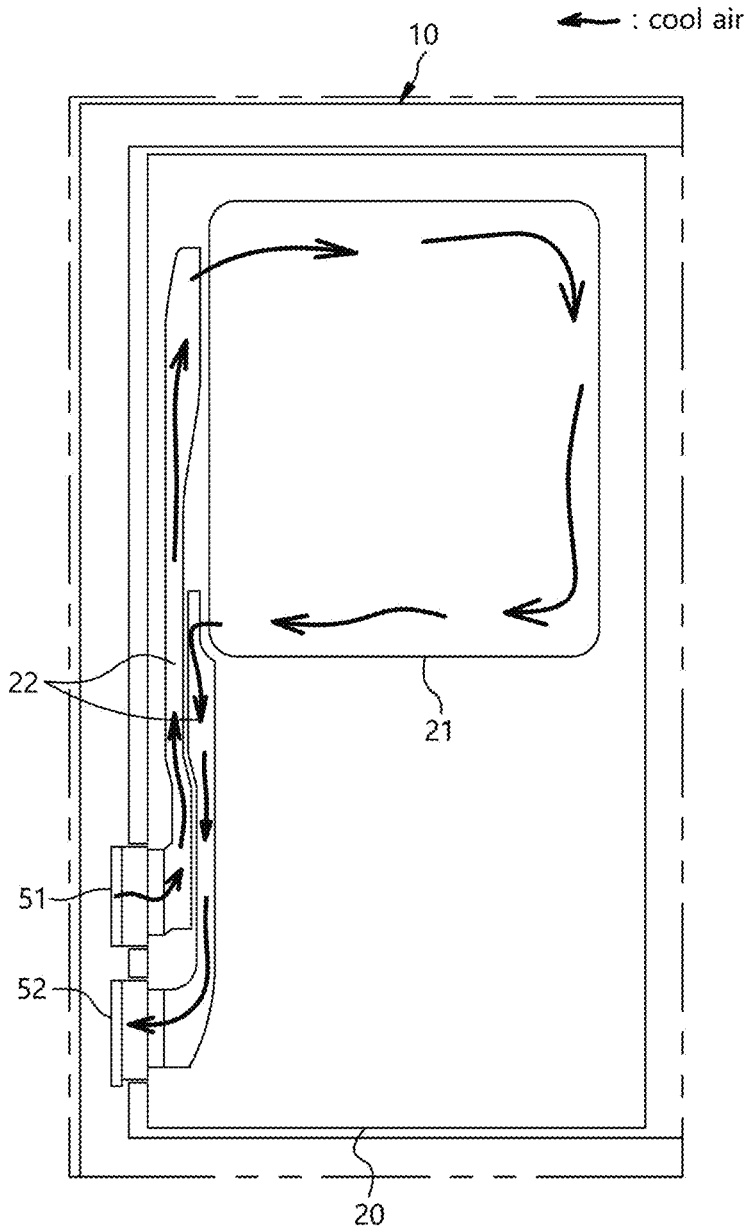
FIG. 32 is a state view showing an example of flow of cool air supplied to and recovered from the ice-making compartment.

Next, the operation for controlling the temperature in the ice-making compartment 21 (ice-making operation) will be described with reference to FIGS. 30 to 32.

The temperature control of the ice-making compartment 21 may be performed by the operation of the ice-making fan 421 by power supply to the ice-making fan module 420. The compressor may be operated or stopped in response to operating conditions of the freezing compartment 12.

When the ice-making fan 421 is operated, air existing in the freezing compartment 12 may pass through the second evaporator 32 by the air blowing force of the ice-making fan 421 and then be introduced through the inlet hole 511 for the ice-making compartment into the duct housing 510.

Then, the cool air may be discharged toward the side to which the cool air duct 51 for the ice-making compartment is connected by being guided by the circumferential wall 513 constituting the duct housing 510.

The cool air discharged to the cool air duct 51 for the ice-making compartment may flow along the cool air duct 51 for the ice-making compartment and be supplied to the ice-making compartment 21.

Furthermore, the cool air supplied to the ice-making compartment 21 may freeze water (or other beverages) in an ice tray while flowing in the ice-making compartment 21, and then may be recovered into the freezing compartment 12 through a recovery duct 52 for the ice-making compartment.

The cool air recovered to the freezing compartment 12 may flow in the freezing compartment 12 and then be recovered into an air inlet side of the second evaporator 32 by being guided by the suction guide 250 formed on the grille panel 200.

When the temperature in the ice-making compartment 21 is lower than the preset temperature, the supply of cool air to the ice-making compartment 21 may be stopped while the operation of the ice-making fan 421 is stopped.

Accordingly, the temperature in the ice-making compartment 21 may be controlled by the repeated circulation of air (cool air) described above.

Therefore, the refrigerator may include the discharge guide duct 600 in front of the first cool air outlet 210, so that part of cool air discharged through the first cool air outlet 210 may be intensively supplied toward a specific position.

That is, since the cool air may be continuously supplied toward the ice maker 12*a* in the freezing compartment 12, it is possible to solve the problem in which ice quality fluctuates in response to overall temperature variation in the freezing compartment 12 or flow variation of cool air flowing in the freezing compartment 12.

Furthermore, the refrigerator may be configured such that the blower fan module 410 is positioned between the shroud 100 and the grille panel 200 and is fastened to the fastening protrusions 141, 142, and 143 formed on the shroud 100, so that the grille panel assembly may be slimmed.

Furthermore, the refrigerator may be configured such that the duct connection part 500 having the ice-making fan module 420 is arranged in one empty space of the rear surface of the grille panel 200 where the shroud 100 is not installed, and the temperature sensor 260 is arranged in another empty space thereof, so that the grille panel assembly 1 may be made compact.

Furthermore, the refrigerator may have the blower fan module 410 and the ice-making fan module 420 that are formed to have the same size so that it is possible to achieve common use of the fan, and may have the inlet holes 110 and 511 having different opening width so that cool air may be supplied as different air volumes and air speeds.

Furthermore, the refrigerator may have the fourth cool air outlet 240 formed on the grille panel 200 and being open toward the opposite side wall surfaces in the freezing compartment 12, so that the cool air may be supplied to the rear surface of the freezing compartment 12 or the opposite wall surfaces in the rear side.

Furthermore, the refrigerator may have the fourth cool air outlet 240 that is positioned at different height than the second cool air outlet 220 and the third cool air outlet 230, so that interference between the cool air discharged toward the front side of the freezing compartment 12 and the cool air discharged toward the opposite side wall surfaces of the freezing compartment 12 may be prevented or reduced.

What is claimed is:

1. A refrigerator comprising:

a cabinet comprising a freezing compartment and a refrigerating compartment;

an evaporator disposed inside the freezing compartment and configured to cool air;

a shroud that is disposed at a front side of the evaporator and that defines an inlet hole facing the front side of the evaporator;

a grille panel that is coupled to a front surface of the shroud and defines a plurality of cool air outlets configured to discharge the cool air to the freezing compartment;

a blower fan module disposed between the grille panel and the shroud and configured to blow the cool air from the evaporator toward the cool air outlet;

a duct connection part disposed at a rear surface of the grille panel; and an ice-making fan module disposed in an inside of the duct connection part and configured to supply the cool air to an ice-making compartment, wherein an upper width of the grille panel is greater than an upper width of the shroud, wherein the upper width of the shroud is less than a lower width of the shroud to thereby define corner spaces that expose upper corner portions of the rear surface of the grille panel, respectively, and wherein the duct connection part is disposed at one of the corner spaces of the grille panel.

2. The refrigerator of claim 1, wherein the duct connection part comprises:

a duct body coupled to the grille panel; and a duct housing that is coupled to the duct body and defines an inlet configured to communicate with the ice-making compartment.

3. The refrigerator of claim 2, wherein the duct housing comprises:

a body wall that defines the inlet of the duct housing; and a circumferential wall that surrounds a circumference of the body wall.

4. The refrigerator of claim 3, wherein the circumferential wall of the duct housing has a round shape surrounding the ice-making fan module and defines an open portion that is open in a tangential direction of the circumferential wall of the duct housing.

5. The refrigerator of claim 4, further comprising a cool air duct that is in fluid communication with the ice-making compartment and connected to the open portion of the circumferential wall.

6. The refrigerator of claim 3, wherein the circumferential wall of the duct housing defines a drain hole configured to discharge condensed water from an inside of the duct housing.

7. The refrigerator of claim 6, wherein the drain hole is an opening defined at a lower end of the circumferential wall.

8. The refrigerator of claim 2, wherein the ice-making fan module comprises:

a duct installation frame that has a plate shape, the duct installation frame having a first side that faces the duct body and a second side that faces the duct housing;

a duct hub part that is rotatably coupled to the second side of the duct installation frame and faces the inlet of the duct housing; and a duct impeller disposed in the duct hub part.

9. The refrigerator of claim 2, wherein the duct body is coupled and fixed to the grille panel with screws that fix the duct housing to the grille panel.

10. The refrigerator of claim 1, further comprising a temperature sensor configured to measure a temperature in the freezing compartment.

11. The refrigerator of claim 10, wherein the temperature sensor is disposed at the other one of the corner spaces of the grille panel where the duct connection part is not disposed.

12. The refrigerator of claim 1, further comprising a discharge guide duct that defines a discharge position of cool air discharged from a first cool air outlet among the plurality of cool air outlets to the freezing compartment.

13. The refrigerator of claim 12, wherein the discharge guide duct extends forward toward the freezing compartment, and wherein a width of the discharge guide duct decreases as the discharge guide duct extends forward to thereby concentrate and spray the cool air to the freezing compartment.

14. The refrigerator of claim 13, wherein the discharge guide duct extends away from the first cool air outlet as the discharge guide duct extends forward to thereby reduce a flow interference between the discharge guide duct and the cold air discharged from the first cool air outlet through other portions of the first cool air outlet disposed outside the discharge guide duct.

* * * * *